US012440073B1

(12) United States Patent
Jacobs

(10) Patent No.: US 12,440,073 B1
(45) Date of Patent: Oct. 14, 2025

(54) TUBE HOLDER WITH RETRACTABLE BARRIER(S)

(71) Applicant: Robert Jacobs, Crystal Beach, FL (US)

(72) Inventor: Robert Jacobs, Crystal Beach, FL (US)

( * ) Notice: Subject to any disclaimer, the term of this patent is extended or adjusted under 35 U.S.C. 154(b) by 0 days.

(21) Appl. No.: 17/576,959

(22) Filed: Feb. 11, 2022

(51) Int. Cl.
*A47K 10/22* (2006.01)
*A47K 10/32* (2006.01)

(52) U.S. Cl.
CPC ..... *A47K 10/22* (2013.01); *A47K 10/32* (2013.01)

(58) Field of Classification Search
CPC ..... A47K 10/22; A47K 2010/3246; A47K 10/00; A47K 10/02; A47K 10/025; A47K 10/04; A47K 10/06; A47K 10/08; A47K 10/10; A47K 10/16; A47K 10/18; A47K 10/20; A47K 10/24; A47K 10/32; A47K 2010/3233; A47K 2010/324; A47K 2010/3253; A47K 2010/326
USPC ..... 248/221.11
See application file for complete search history.

(56) References Cited

U.S. PATENT DOCUMENTS 1,105,951 A * 8/1914 Ragnall ..... A47K 10/22 242/599.3
1,229,431 A * 6/1917 Farrell ..... A47K 10/22 242/596.3
1,462,176 A * 7/1923 Hartmeyer ..... A47K 10/38 242/598.2
1,665,738 A * 4/1928 Hoegger ..... A47K 10/22 242/598.2
1,815,068 A * 7/1931 Parsons ..... A47K 10/22 242/596.8
2,201,052 A * 5/1940 Parsons ..... A47K 10/22 242/598.3
2,449,598 A * 9/1948 Foltis ..... A47K 10/22 242/610.2
2,466,957 A * 4/1949 Lewis ..... A47K 10/22 242/598.2
2,602,601 A * 7/1952 Balz ..... A47K 10/22 242/599.1
2,632,605 A * 3/1953 Lee ..... A47K 10/3836 242/597.3
2,904,274 A * 9/1959 Hicks ..... A47K 10/22 242/560.3
3,346,208 A * 10/1967 Hoffman ..... B65H 75/08 242/597.5
3,484,052 A * 12/1969 Clarke ..... A47K 10/3836 242/597.3

(Continued)

*Primary Examiner* — Terrell L McKinnon
*Assistant Examiner* — Michael McDuffie
(74) *Attorney, Agent, or Firm* — Michael D. Eisenberg

(57) ABSTRACT

A tube holder comprising: a rod having an outer diameter that is smaller than an inner diameter of a tube, wherein said rod is adapted to receive said tube thereon; and two barriers adapted to keep said tube in a dispensing position on said rod between said barriers. At least one of said barriers is a retractable barrier adapted to move between an extended position and a retracted position within said rod. The extended position prevents axial movement of said tube past said retractable barrier and said retracted position allows axial movement of said tube past said retractable barrier. Thus, said tube holder is configured for loading said tube into said dispensing position when said retractable barrier is in said retracted position and for locking said tube into said dispensing position when said retractable barrier is in its extended position.

13 Claims, 23 Drawing Sheets

(56) References Cited

U.S. PATENT DOCUMENTS

| | | | | | |
|---|---|---|---|---|---|
| 4,553,710 | A * | 11/1985 | Pool | A47K 10/40 | 242/596.4 |
| 5,314,131 | A * | 5/1994 | McCanless | A47K 10/3836 | 242/559 |
| 5,645,247 | A * | 7/1997 | Voigt | D04C 3/18 | 242/130.4 |
| 5,887,818 | A * | 3/1999 | Kelley | A47K 10/3836 | 242/559.3 |
| 5,901,921 | A * | 5/1999 | Perlsweig | A47K 10/3836 | 242/597 |
| 6,328,246 | B1 * | 12/2001 | Hjort | A47K 10/3836 | 242/422.5 |
| 8,282,034 | B1 * | 10/2012 | Channel | A47K 10/38 | 242/597.5 |
| 8,616,491 | B2 * | 12/2013 | Smith | A47K 10/40 | 242/596.7 |
| 9,661,959 | B2 * | 5/2017 | Prior | A47K 10/22 | |
| 10,182,686 | B2 * | 1/2019 | Chen | A47K 10/18 | |
| 10,264,928 | B1 * | 4/2019 | Cox | B65D 25/106 | |
| 10,710,832 | B2 * | 7/2020 | Rozek | B65H 75/185 | |
| 10,856,707 | B2 * | 12/2020 | Peterson | A47K 10/32 | |
| 10,905,293 | B2 * | 2/2021 | Cohen | A47K 10/3836 | |
| 2004/0178298 | A1 * | 9/2004 | Kennard | A47K 10/34 | 242/570 |
| 2016/0256018 | A1 * | 9/2016 | Viessman | A47K 10/3836 | |
| 2018/0014700 | A1 * | 1/2018 | Rickert | A47K 10/16 | |
| 2018/0249869 | A1 * | 9/2018 | Wright | A47K 10/38 | |

* cited by examiner

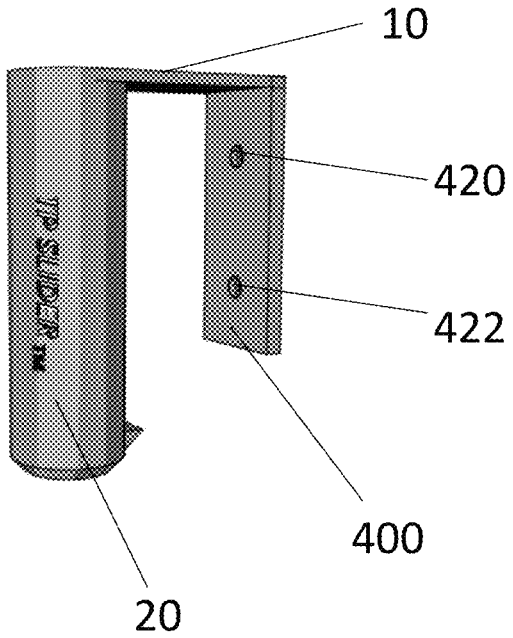
Figure 12
Figure 13
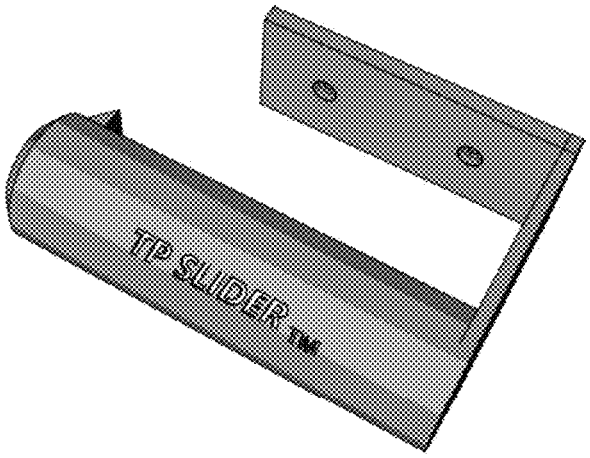
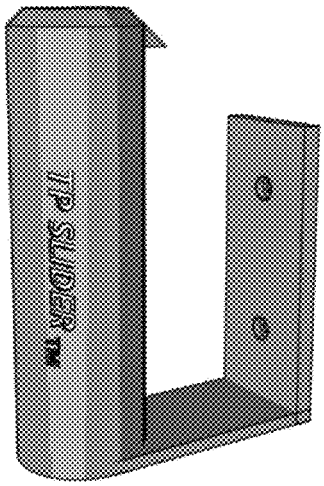
Figure 14

TUBE HOLDER WITH RETRACTABLE BARRIER(S)

TECHNICAL FIELD

The present application, in some embodiments thereof, relates to holders and dispensers for any tube containing a roll of material to be dispensed including, but not necessarily limited to, toilet paper, paper towels, aluminum foil, wax paper, parchment paper, cellophane wrap, fabric.

BACKGROUND

The vast majority of related prior art involves toilet paper holders (also referred to as dispensers). As such, the "tube" will hereinafter be referred to interchangeably as a "TP Roll", and the "tube holder" will hereinafter be referred to interchangeably as a "TP Holder".

Prior art TP Holders come in two general categories, ones with movable rods ("traditional") and ones with fixed rods ("alternative").

A traditional TP Holder keeps a TP Roll securely in place, but is often not used because it is cumbersome to change the TP Roll. A traditional TP Holder includes a movable rod that is temporarily fixed in a dispensing position between a left and right barrier. The TP Roll is somehow placed on the rod and kept securely in its dispensing position by the barriers. The left barrier completely prevents axial movement of the TP Roll to the left and the right barrier completely prevents similar movement to the right. In order to place a new TP Roll on the rod, or take an empty TP Roll off the rod, it is required to somehow manipulate the rod. Prior art has provided a wide variety of means to manipulate the rod that involve springs or hinges or other devices that are costly, prone to mechanical failure, and otherwise difficult and/or cumbersome to use.

An alternative group of TP Holders provide very easy means to change the TP Roll, but does not keep the TP Roll securely in place. This group of TP Holders includes a stationary rod that does not have to be manipulated in order to change the TP Roll. These holders provide one barrier that completely prevents axial movement of the TP Roll in a first direction and a second barrier that only partially prevents axial movement of the TP Roll in the second axial direction toward an open end of the rod. The second barrier allows the TP Roll to be easily put on and taken off the rod when desired. Unfortunately, to the extent the second barrier allows the TP Roll to be easily put on or taken off the rod when desired, it also suffers from the problem that the TP roll can be inadvertently or unintentionally removed from the rod when not desired.

All prior art holders exist on a continuum that either has means to completely secure the TP Roll in place OR has means to easily replace the TP Roll. The easier it is to replace the TP Roll, the harder it is to secure it in place. The more secure it is in its dispensing position, the harder it is to replace the TP Roll. No prior art does both successfully, easily, and inexpensively.

Another problem that needs to be solved is that prior art devices allow the TP Roll to continue to spin after plies of tissue are torn from the TP Roll, whereby toilet paper is unintentionally spun off the Roll (hereinafter referred to as "runaway TP". When this results in toilet paper touching the floor, that paper is usually thrown away. This is a waste of toilet paper. What is needed is a TP Holder that reduces the speed at which the TP Roll is spun to decrease the amount of runaway TP.

BRIEF SUMMARY OF THE INVENTION

An aim of the present invention is to provide a tube holder that allows easy loading and unloading of a tube and keeps the tube secure in its dispensing position.

An aim of the present invention is to provide a tube holder that reduces manufacturing and assembly costs and can therefore be sold for an inexpensive price.

An aim of the present invention is to provide a tube holder that is easy to install and can be installed in a variety of positions adapted to the configuration of different bathrooms and personal preferences of the owner. These positions include parallel or perpendicular to the wall.

An aim of the present invention is to provide a tube holder that can be loaded and unloaded from a variety of directions adapted to the configuration of different bathrooms and personal preferences of the owner; including from above, below, from the right or from the left, or straight on.

An aim of the present invention is to provide a tube holder that takes up minimal amount of shelf space in retail stores.

An aim of the present invention is to provide a tube holder that has a low visual profile.

An aim of the present invention is to provide a tube holder whose operation is uncomplicated and self evident (that requires no instructions to change tubes).

An aim of the present invention is to provide a tube holder with parts that are not prone to mechanical failure.

An aim of the present invention is to provide a tube holder that can store spare rolls that are easily moved into a dispensing position.

An aim of the present invention is to provide a tube holder that prevents theft of active and stored tubes on the tube holder.

An aim of the present invention is to provide a tube holder that can be used to easily and quickly dispose of empty rolls.

Therefore, an aspect of some embodiments of the present invention relates to This invention includes a Rod with two Barriers, at least one of which is retractable. The area on the Rod between the two Barriers define a Dispensing Position onto which a Toilet Paper Roll (TP Roll) or other material-containing Tube (referred to in the claims as "Tube") can easily be slid. The Retractable Barrier(s) is (are) movable between a Retracted Position inside the Rod and an Extended Position mostly outside the Rod. In its Retracted Position, the Barrier(s) provides no impediment to a TP roll sliding past it. In its Extended Position, the inner surface of the Barrier(s) prevents the TP Roll from sliding past it. The Retractable Barrier(s) is (are) preferably biased into its Extended Position when not retracted by the user. The Rod preferably has a diameter that is larger than that of a rod used in the prior art, to create more friction between the inner surface of the Inner Tube of the TP Roll and the outer surface of the Rod, thus preventing TP Runaway by forcing the TP Roll to spin more slowly. The larger diameter also limits the degree to which the Tube can be deformed when on the Rod and this, in turn, decreases the distance that the retractable Barrier needs to be extended from the Rod. One end of the Rod is open and preferably has a reduced diameter to allow easy loading of the TP Roll.

In a first embodiment adapted to hold one TP Roll, the rod includes one permanent barrier defining a closed (proximal) end of the Rod and one Retractable Barrier located at an open (distal) end of the Rod. Means may be provided to bias the Retractable Barrier into its Extended Position, for example by either a spring or by positioning the Retractable Barrier such that gravity forces it into that position. The Retractable Barrier includes an actuating surface that, upon contact with a TP Roll sliding into its Dispensing Position on the Rod, moves the Barrier into its retracted position. This embodiment allows a TP Roll to easily slide onto the Rod and into its Dispensing Position without the user contacting the Retractable Barrier. Removal of an empty TP Roll involves retracting the Retractable Barrier by pressing on a button surface of the Barrier while simultaneously grabbing the empty tube and sliding it off the Rod, an extremely easy and intuitive movement that requires only one hand.

In a second embodiment adapted to hold two or more TP Rolls, the rod includes two Retractable Barriers, one located at the distal open end of the Rod and one disposed proximally of the distal end, near a storage end of the Rod. In this embodiment, the Dispensing Position is defined by the Rod area between the inner surfaces of the two Barriers. The Rod in this embodiment also has a storage area onto which one or more spare TP Roll(s) can be placed by first sliding the TP Roll into the Dispensing Position and then retracting the storage side Barrier and further sliding the TP Roll(s) onto the storage area of the Rod. Each Barrier has an inner surface that prevents the TP Roll from sliding past it and an outer actuating surface that forces the Barrier to retract upon contact with a sliding TP Roll. This embodiment allows the empty TP Roll to be removed with one hand, just as discussed with the first embodiment. This second embodiment allows a new TP Roll to be slid from the Storage position to the dispensing position with just one finger.

In a third main embodiment, also adapted to hold two or more TP Rolls, the Rod includes one Retractable Barrier located near a storage end of the Rod and a Movable (not retractable) Barrier located at or near the distal open end of the Rod. The Movable Barrier is adapted to be placed in an operative Barrier Position that allows the Inner Tube of a TP Roll to slide past it, but does NOT allow the toilet paper on that same TP Roll to slide past it. And the Movable Barrier is adapted to be removed from the operative Barrier Position, allowing loading of multiple TP Rolls into the storage position to be accomplished the same way as discussed in the second preferred embodiment. However, in this embodiment, when the Movable Barrier is returned to it Barrier position, removal of an empty TP Roll from its Dispensing Position and loading a new TP into the Dispensing Position can be accomplished simultaneously with one finger by simply sliding the next-in-line stored TP Roll to the Dispensing Position. The leading edge of the Inner Tube of the next-in-line TP Roll first retracts the Retractable Barrier and then contacts the trailing edge of the empty roll sliding it past the Movable Barrier and off the Rod. Locking Means can be provided to lock the Movable Barrier in place to prevent theft of the TP Rolls.

BRIEF DESCRIPTION OF DRAWINGS

FIG. 12 is a front perspective view of the tube holder mounted with the open end of the rod facing downward, according to some embodiments of the present invention.

FIG. 13 is a front perspective view of the tube holder mounted with the open end of the rod facing to the side, according to some embodiments of the present invention.

FIG. 14 is a front perspective view of the tube holder mounted with the open end of the roll facing upward, according to some embodiments of the present invention.

Figure 1:
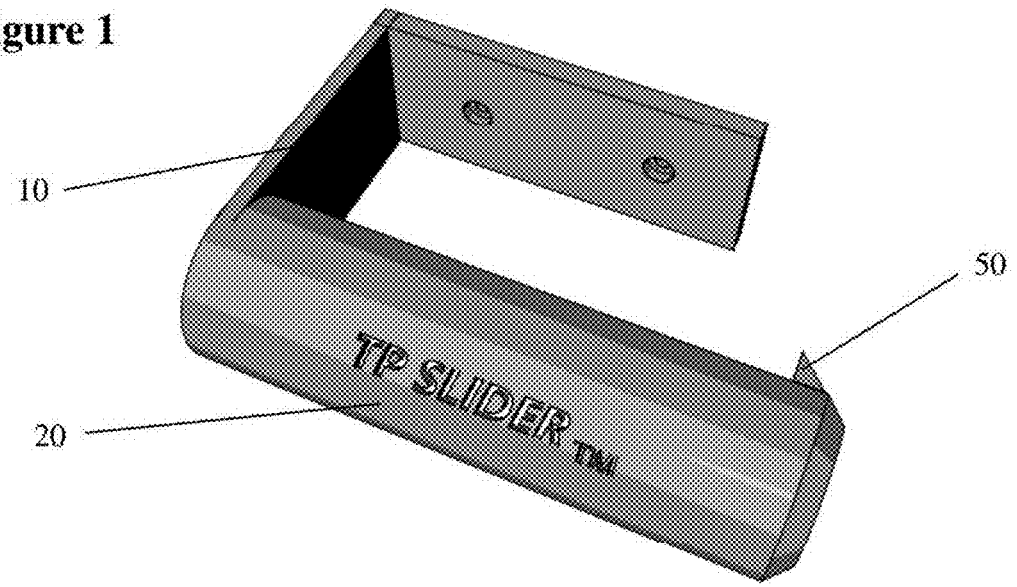
FIG. 1 is a top front perspective view of a tube holder adapted to hold one tube, with an open end of the tube holder facing to the right, according to some embodiments of the present invention.
Figure 2:
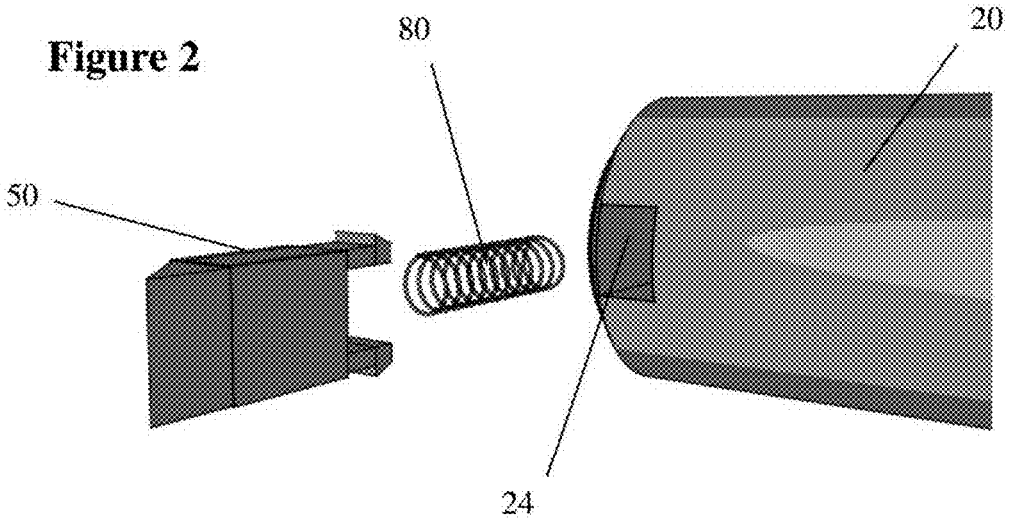
FIG. 2 is an exploded close-up view of the open end of a rod of the tube holder of FIG. 1, according to some embodiments of the present invention.
Figure 3:
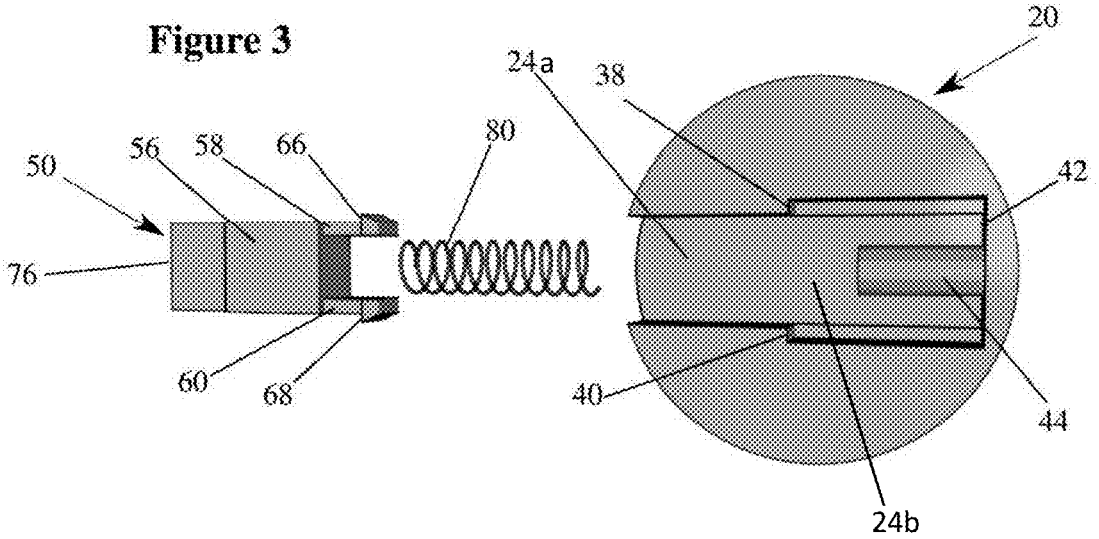
FIG. 3 is cross-sectional view of the rod of the tube holder of FIG. 1 and an exploded view of the spring and retractable barrier, according to some embodiments of the present invention.
Figure 4:
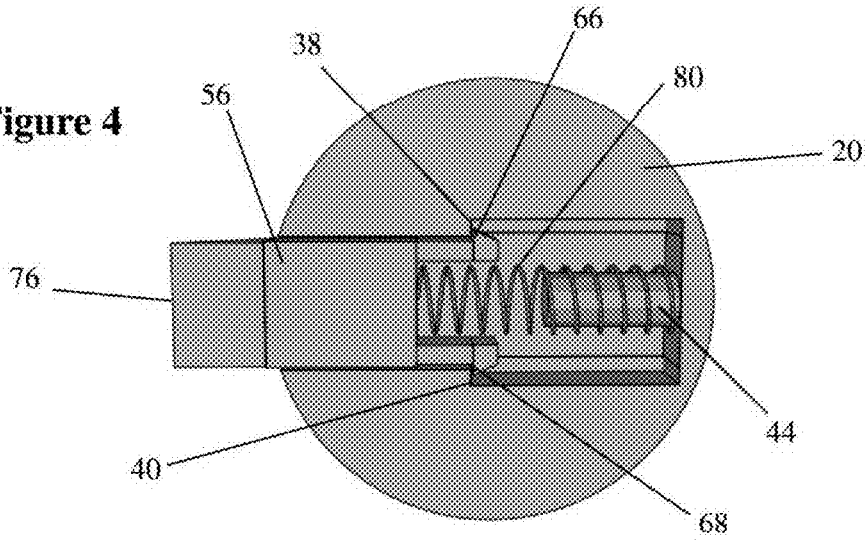
FIG. 4 is a cross-sectional view of the rod of the tube holder of FIG. 1, showing the retractable barrier in its extended position, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The inventor has found that completely securing a toilet paper roll (or any other kind of roll) in its dispensing position on a rod requires only that the inner tube of the roll be secured, and that securing the inner tube requires only a small barrier that can be moved during loading and unloading of the roll. As such, each embodiment of this invention includes one or two small retractable barrier(s) that can be easily moved with one finger or by contact with the leading edge of a roll sliding into its dispensing position.

In FIGS. 1-18B. a first main embodiment of the present invention relates to a tube holder including a fixed barrier 10 and a single retractable barrier 50.

Referring now to FIGS. 1-18B, embodiments of the present invention are illustrated, in which a tube holder includes Rod 20, Fixed Barrier 10 and Retractable Barrier 50. Rod 20 has a distal end 22 and a proximal end 46. The proximal end 46 is joined to Fixed Barrier 10. The distal end 22 is a free (open end). Retractable Barrier 50 is located at or near the distal end 22.

In the embodiments of FIGS. 1-18B, Retractable Barrier 50 is configured to extend radially out of Rod 20 in its barrier configuration and to retract into Rod 20 in its retracted configuration.

Rod 20 has a diameter that is slightly smaller than the diameter of Inner Tube 4 of Roll 2, thus allowing Roll 2 to fit thereon. The larger the circumference of Rod 20 the more contact it has with the inner surface of Inner Tube 4 thus creating more friction when Roll 2 is turned. This slows the spinning of the Roll and reduces the possibility of runaway paper. The large circumference of Rod 20 also allows room for Retractable Barrier 50 within the rod, as will discussed below.

In some embodiments of the present invention, the distal end 22 of Rod 20 is a loading end with a reduced circumference as compared to the circumference of the rest of the Rod 20, which makes it easy for a user to slide Roll 2 onto Rod 20.

Roll 2, is in dispensing position when located on the Rod 20 between the Fixed Barrier 10 and Retractable Barrier 50. The length of the dispensing region between the Fixed Barrier 10 and Retractable Barrier 50 may be slightly larger than the longitudinal length of Roll 2.

In some embodiments of the present invention, Rod 20 includes Shaft 24, Ledges 38, 40, Ceiling 42 and First Spring Guide 44. Shaft 24 extends radially inside Rod 20, and has a narrow section 24*a* near the aperture of the shaft and an expanded section 24*b* between the narrow section and the ceiling 42. The ledges 38 and 40 are formed where the expanded section 24*b* narrows into the narrow section 24*a*. First Spring Guide 44 is a pole joined to Ceiling 42 and extending toward the aperture of Shaft 24. Spring 80 is held into position by First Spring Guide 44.

Retractable Barrier 50 is preferably a single piece that has several functions defined by its separate areas including Barrier Surface 52, Actuator Surface 54, Post 56, Flexible Projections 58, 60, Overhangs 66, 68, and Button Edge 76. Post 56 can be any shape that is capable of sliding freely within Shaft 24. In this embodiment, the walls of Post 56 are rectangular because Shaft 24 is similarly shaped. Post 56 is slightly smaller than Shaft 24 so it can slide freely therein.

Retractable Barrier 50 is pushed through the opening with Barrier Surface 52 facing Fixed Barrier 10, and Actuator Surface 54 facing the distal end 22 of Rod 20. Post 56 is forced through Shaft 24 allowing Flexible Projections 58 and 60 to flex towards each other as they slide through Shaft 24 until they reach the expanded section 24*b*. In this position, Post 56 is still slidable within Shaft 24, but its movement is restricted in a first direction by the ends of Flexible Projections 58 and 60 contacting Ceiling 42, and in the opposite direction by Overhangs 66 and 68 contacting Ledges 38 and 40.

Spring 80 is kept in place by First Spring Guide 42 and Post 56 to force Retractable Barrier 50 into its extended (barrier) position. In this manner, Retractable Barrier 50 is biased to be in its extended barrier position.

Figure 5:
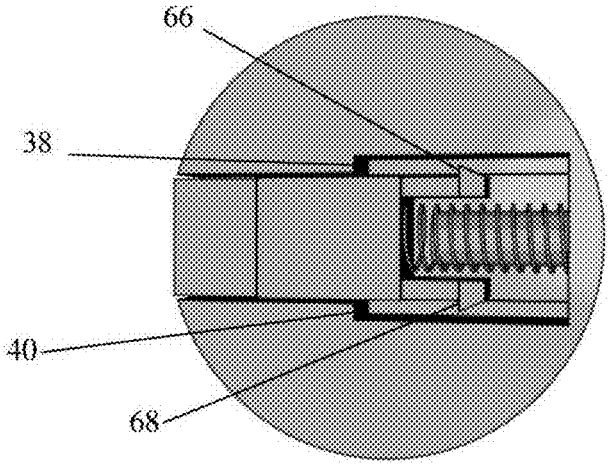
FIG. 5 is a cross-sectional view of the rod of the tube holder of FIG. 1, showing the retractable barrier in its retracted position, according to some embodiments of the present invention.
Figure 6:
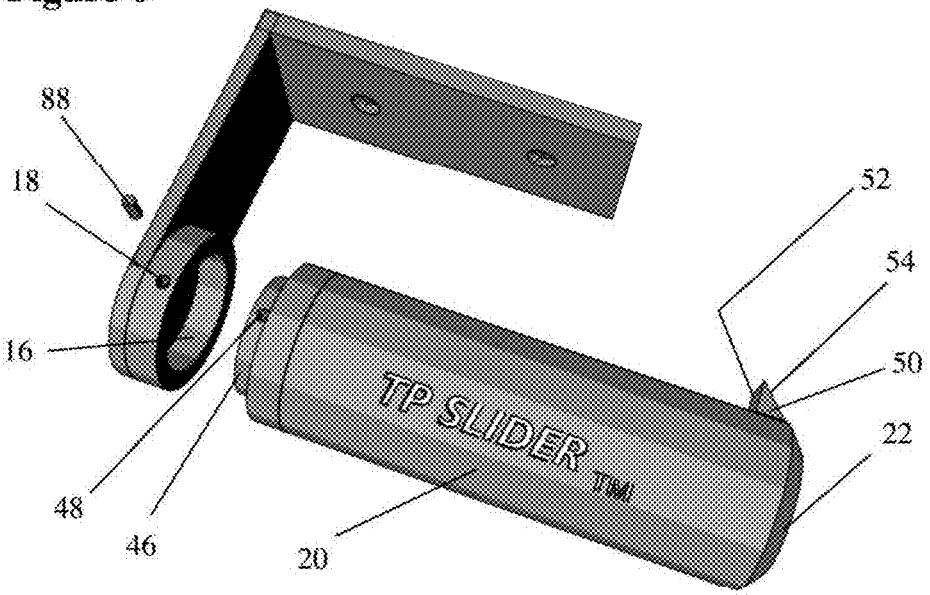
FIG. 6 is a top front perspective view of the tube holder showing the rod before its assembly into the mounting bracket, according to some embodiments of the present invention.
Figure 7:
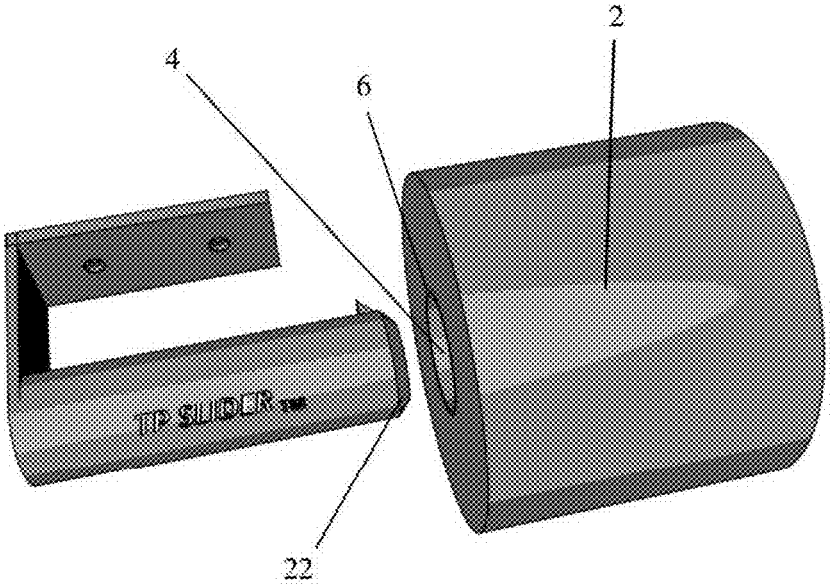
FIG. 7 is a top front perspective view of the tube holder, showing a new toilet paper roll (tube) right before it is slid onto the rod, according to some embodiments of the present invention.
Figure 8:
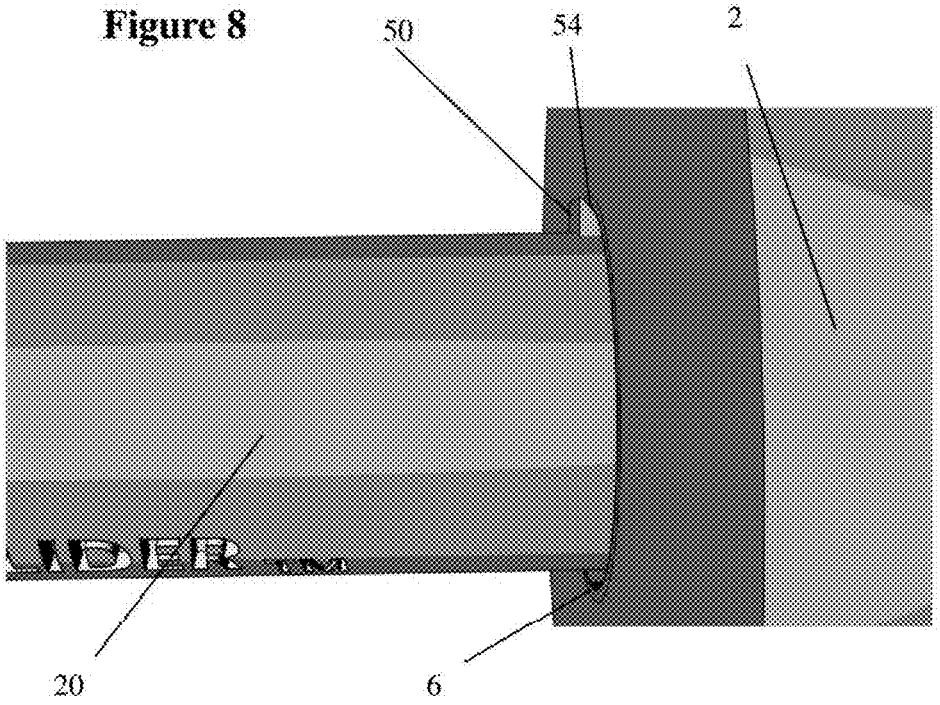
FIG. 8 is a top view of the tube holder, showing the leading edge of the inner tube of a new toilet paper roll contacting the actuator surface of the retractable barrier as the toilet roll is being slid onto the rod, according to some embodiments of the present invention.
Figure 9:
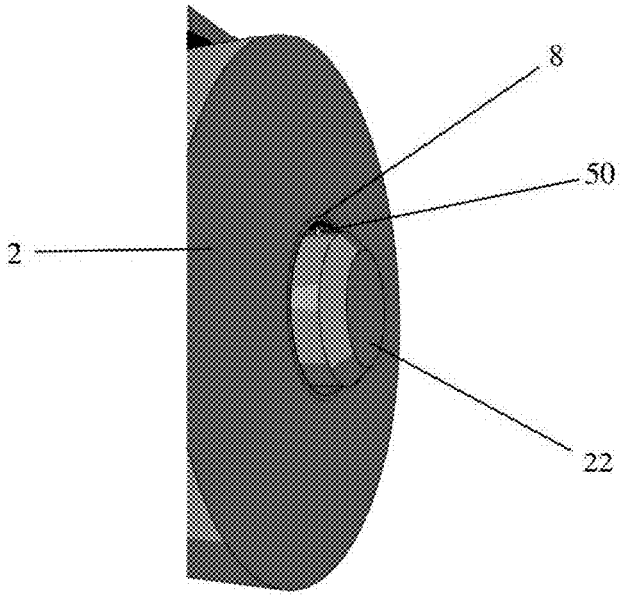
FIG. 9 is a top view of the tube holder, showing the trailing edge of the inner tube of a new toilet paper roll contacting the actuator surface of the retractable barrier as the toilet paper roll is being slid onto the rod, according to some embodiments of the present invention.

Loading is accomplished by simply sliding Roll 2 onto Open End 22 of Rod 10. As shown in FIG. 8, as the leading edge 6 of inner tube 4 of the Roll 2 engages Actuator Surface 54, Retractable Barrier 50 is forced into its retracted position inside the Rod 20, as shown in FIG. 5. As Roll 2 is further slid onto Rod 20, inner tube 4 maintains contact with Button Edge 76 keeping Retractable Barrier 50 retracted, as seen in FIG. 9. When Roll 2 reaches its dispensing position, shown in FIG. 10, Retractable Barrier 50 returns to its extended position as inner tube 4 no longer engages button edge 76.

Figure 10:
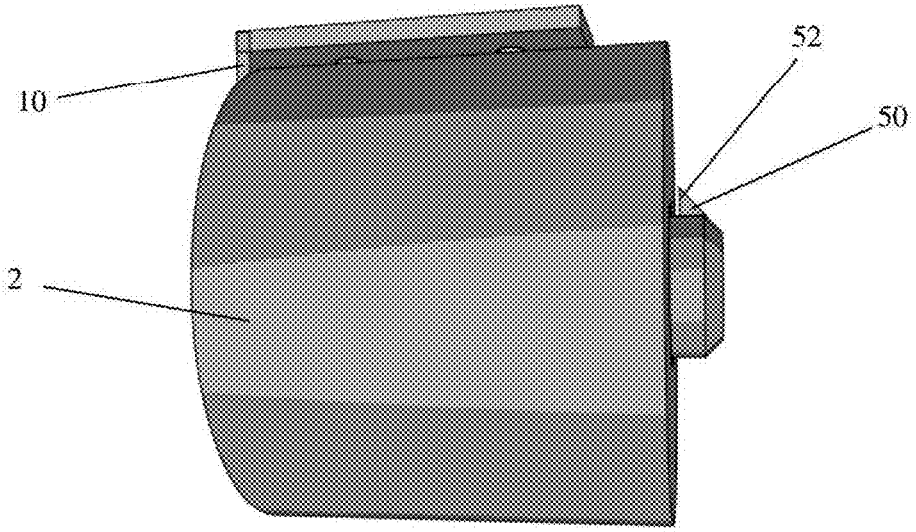
FIG. 10 is a top view of the tube holder, showing the new toilet paper roll in its dispensing position, according to some embodiments of the present invention.
Figure 11:
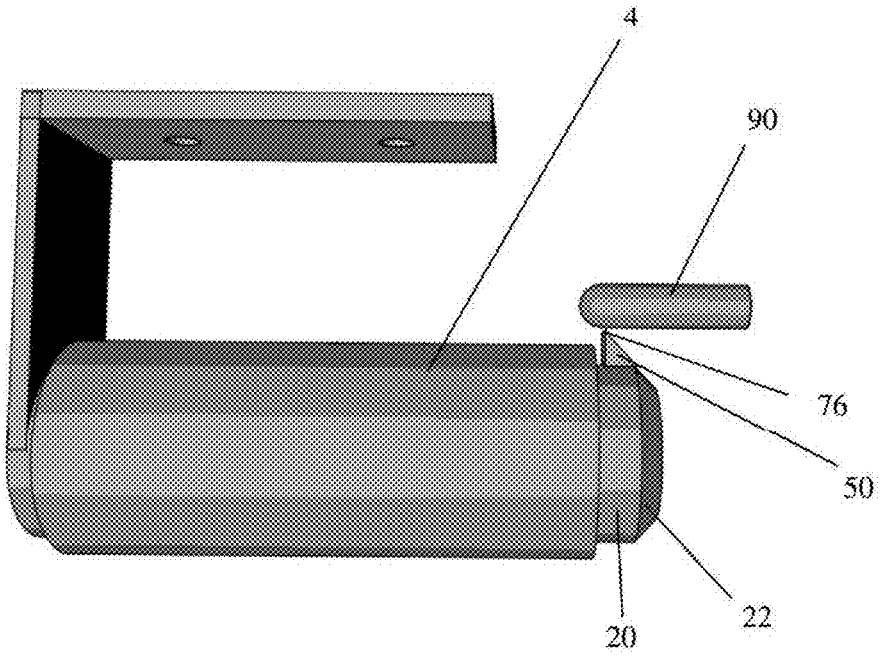
FIG. 11 is a top view of the tube holder, showing an empty toilet paper roll in its dispensing position, according to some embodiments of the present invention.
Figure 15B:
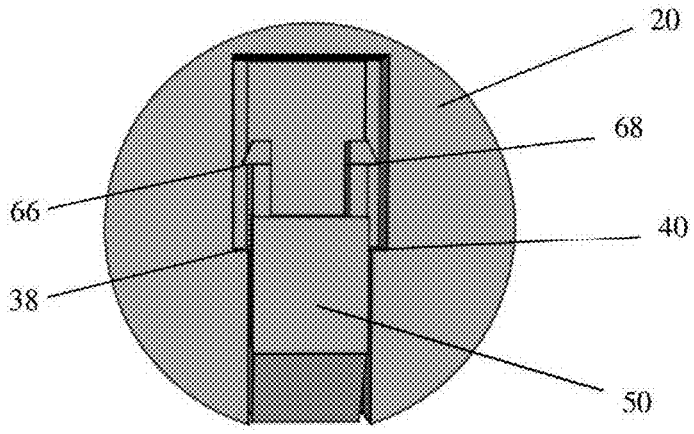
FIG. 15B is a cross-sectional view of the tube holder of FIG. 15A, showing the retractable barrier manipulated into its retracted position.
Figure 15A:
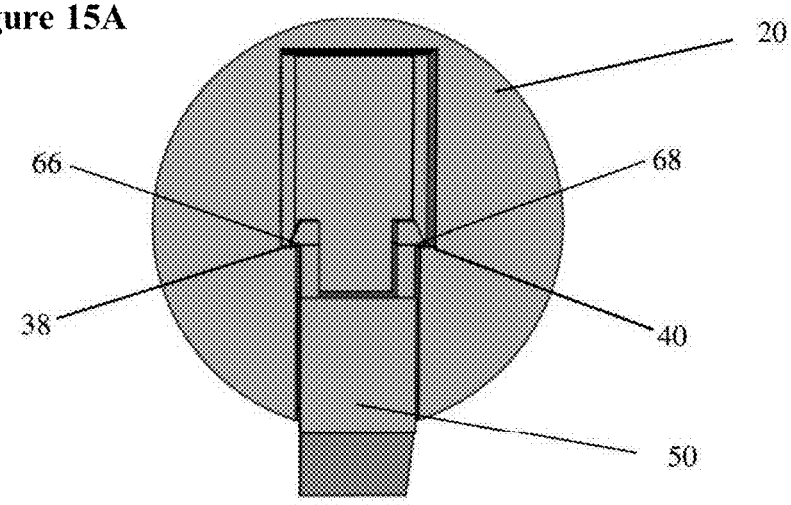
FIG. 15A is a cross-sectional view of a rod of a tube holder of an embodiment of the present invention, in which the retractable barrier faces downward, and is naturally biased into its extended position by gravity.
Figure 15C:
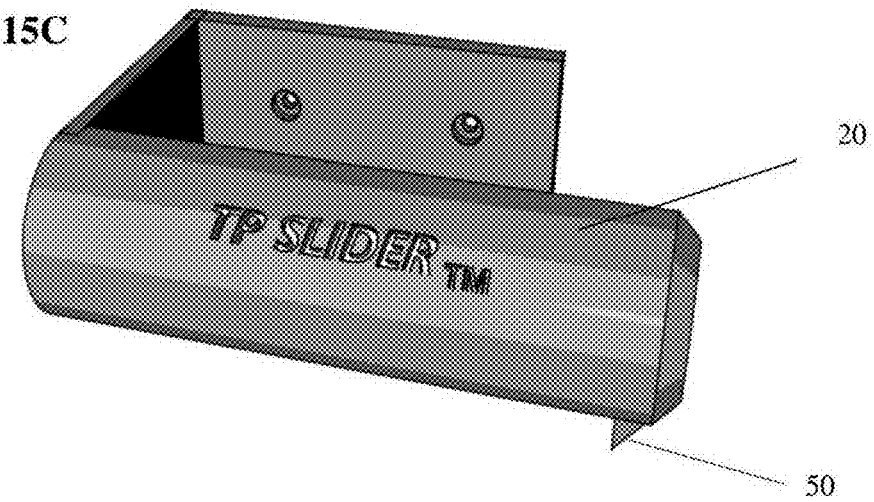
FIG. 15C is a perspective view of a "parallel-mounted" tube holder in which the rod is mounted parallel to the wall and has a downward facing retractable barrier naturally biased into its extended position, according to some embodiments of the present invention.

The dispensing position is defined as the segment on Rod 20 between Fixed Barrier 10 and Barrier Surface 52 of Retractable Barrier 50, onto which Roll 2 is positioned for use, as shown in FIGS. 10 and 11. The dispensing position is only slightly longer than the length of Roll 2 to limit its axial movement on Rod 20.

The distance that Button Edge 76 extends from Rod 20 added to the diameter of Rod 20 exceeds the diameter of inner tube 4 of Roll 2. As such, Tube 4 of Roll 2 is completely prevented from moving past extended Barrier Surface 52 and is kept in the dispensing position when placed therein.

It is immediately obvious to a first time user that Roll 2 is securely kept in place after it is slid onto Rod 20. A first time user will not be concerned how Roll 2 is kept in the dispensing position until it is time a for a new Roll to be inserted. When Roll 2 is empty, the first time user will naturally try to figure out how to remove it, and will immediately see that Retractable Barrier 50 is the only impediment to removing the empty roll from Rod 20. Upon touching Retractable Barrier 50, the user immediately determines that Retractable Barrier 50 is retractable.

As shown in FIG. 11, removal of Inner Tube 4 (empty Roll) is easily accomplished by pushing Button Edge 76 with one finger 90, and thereby retracting Retractable Barrier 50 into Rod 20, while simultaneously grabbing Inner Tube 4 with the other fingers of the same hand and sliding it off Open End 22 of Rod 20. This manner of removing an empty Roll is both common sense and intuitive.

As shown in FIG. 12, the tube holder can be fixed to the wall by first screwing Wall Mount 400 to the wall through screw holes 420, 422. The tube holder includes an arm 10 that acts as the fixed barrier. The arm 10 is joined to the proximal end of Rod 20, and has a rod end joined to Rod 20 and a far end extending perpendicularly to the rod and joined to Wall Mount 400. In this manner, Rod 20 is substantially parallel to the wall to which Wall mount 400 is joined to. In some embodiments of the present invention, the arm 10 is removably joined to Rod 20.

FIGS. 12-14 show how the tube holder can be fixed to the wall in any number of orientations that can be suitable for different bathroom arrangements.

Figure 16A:
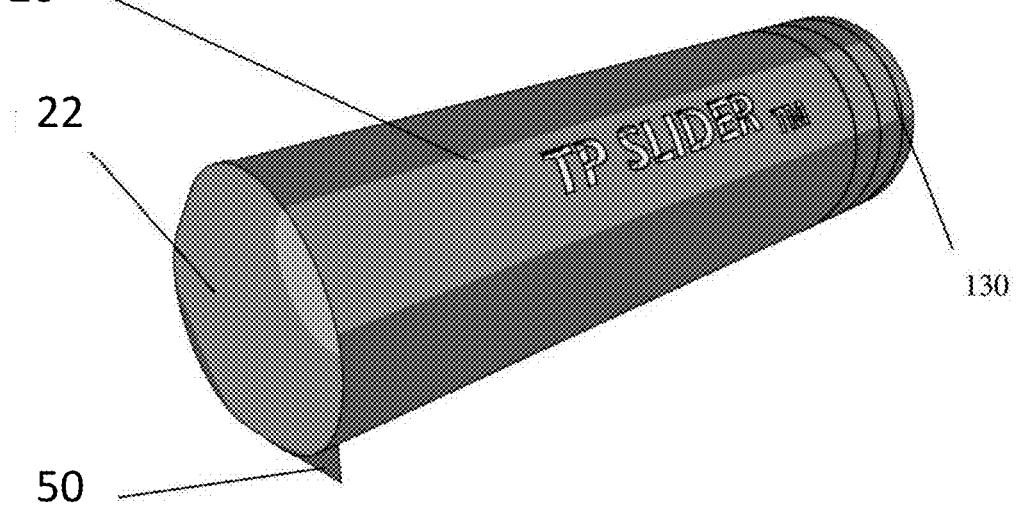
FIG. 16A is a front perspective view of a "perpendicular-mounted" tube holder adapted for mounting the rod perpendicular to a wall, according to some embodiments of the present invention.
Figure 16B:
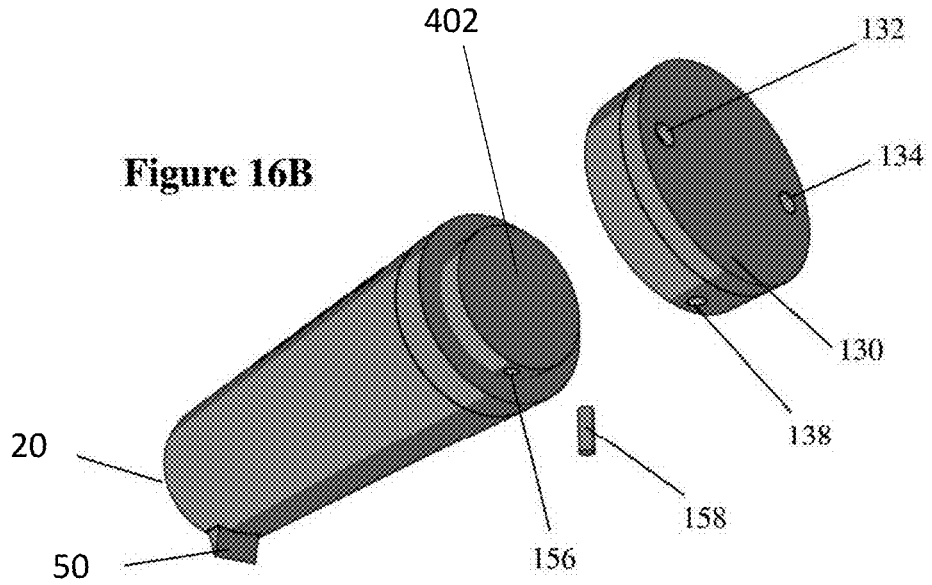
FIG. 16B is a rear perspective exploded view of the "perpendicular-mounted" tube holder shown in FIG. 16A, according to some embodiments of the present invention.
Figure 16C:
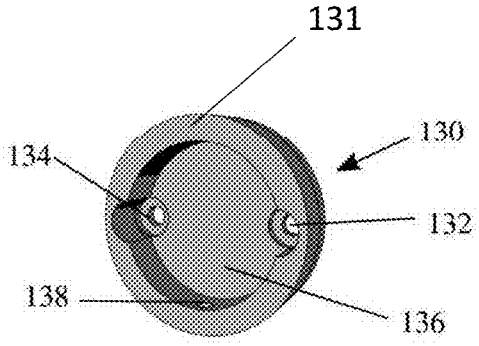
FIG. 16C is a close-up perspective view of the wall mount of the tube holder shown in FIGS. 16A and 16B, according to some embodiments of the present invention.

In another embodiment, as shown in FIGS. 16A-16C, Wall Mount 130 has Female End 136 with Screw holes 132 and 134 drilled therethrough. Pin Hole 138 traverses Circumferential Wall 131 projecting forward of Female End 136. Rod 20 includes Male End 402 which extends axially from the proximal end of Rod 20 and which cooperates with Female End 136 for removable join Rod 20 to Wall mount 130. Second Pin Hole 156 is drilled radially into Male End 402. The tube holder can be fixed to the wall by first screwing Wall Mount 130 to the wall through screw holes 132 and 134, then inserting Male End 402 into Female End 136 aligning Pin Holes 138 and 156, and then inserting Pin 158 through Pin Holes 138 and 156. In this manner, Rod 20 is perpendicular to the wall to which the tube holder is joined to. This is helpful for users who find it more natural to reach for a roll that extends perpendicularly from the wall. This is one means to attach the tube holder to the wall, but others may be used as well and are within the scope of the present invention.

As seen in the examples of FIGS. 15A-18B, in some embodiments of the present invention, the bias of Retractable Barrier 50 to its barrier (extended) position is achieved without a spring. Rather, Rod 20 is oriented such that the opening of Shaft 24 faces downward, such that gravity forces the extension of Retractable Barrier 50 out of shaft 24 when no other force is applied to Retractable Barrier 50.

Figure 17A:
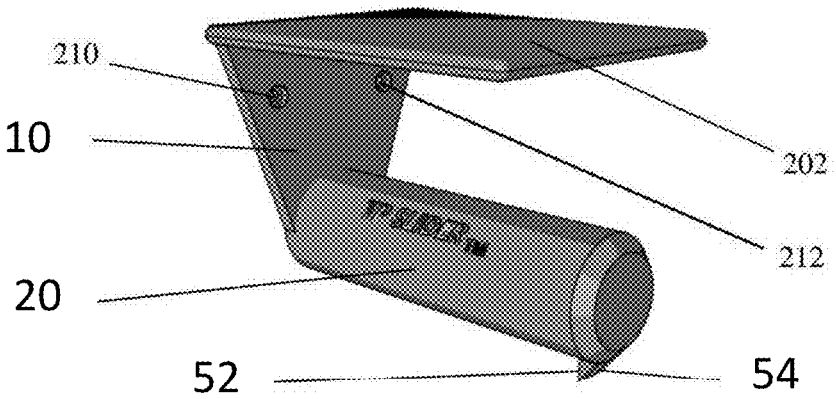
FIG. 17A is a perspective view of a "perpendicular-mounted" tube holder, including a shelf according to some embodiments of the present invention.
Figure 17B:
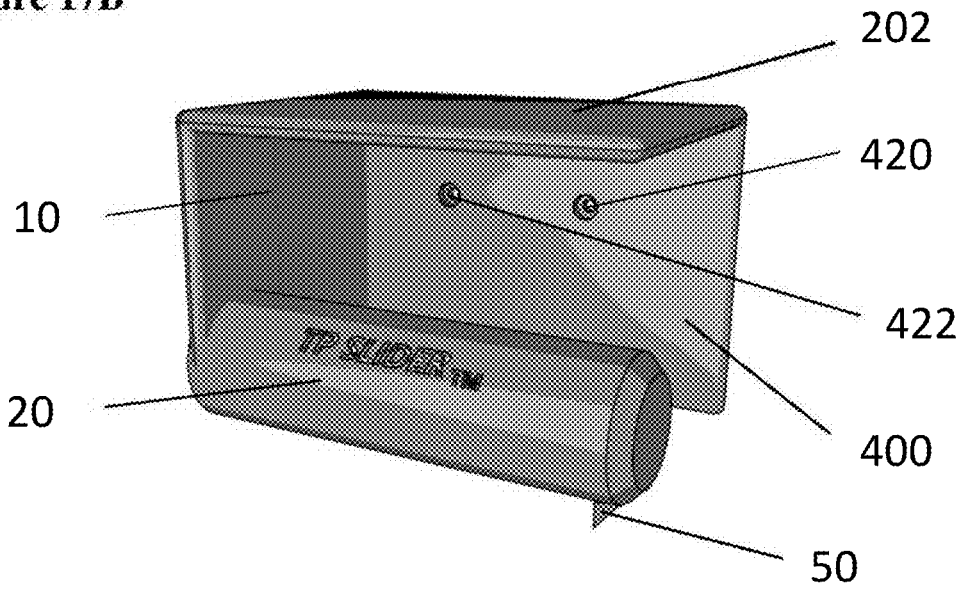
FIG. 17B is a perspective view of a "parallel-mounted" tube holder including a shelf, according to some embodiments of the present invention.

FIGS. 17*a* and 17*b* show some embodiments of the present invention, in which the tube holder of the present invention include a shelf 202 in of the first embodiment with shelves.

In FIG. 17*a*, Rod 20 is perpendicular to the wall. Fixed Barrier 10 extends upwards, parallel to the wall and is affixed to the wall via screws traversing Screw Holes 210 and 212. Shelf 202 extends horizontally from a top end of Fixed Barrier 10 and is substantially parallel to Rod 20 and perpendicular to the wall.

In FIG. 17*b*, Rod 20 is parallel to the wall. Fixed Barrier 10 extends sideways and is joined to Wall Mount 400, which is joined to the wall via screws traversing Screw Holes 420 and 422. Shelf 202 extends horizontally from a top end of Wall Mount 400 and is substantially perpendicular to the wall.

Figure 17C:
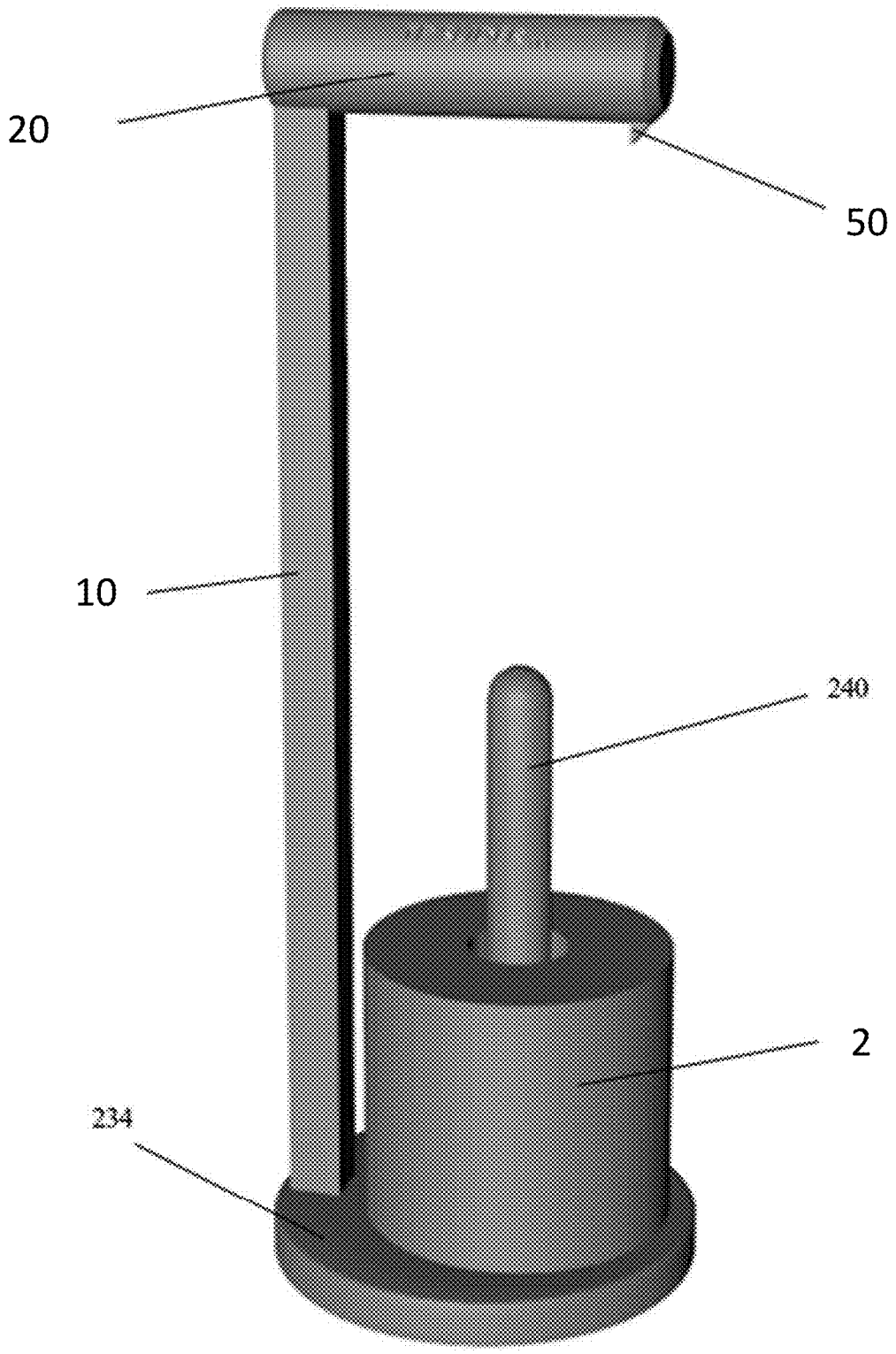
FIG. 17C is a perspective view of a "floor model" tube holder, according to some embodiments of the present invention.

FIG. 17*c* shows a floor model configuration of the present invention. In this example the tube holder includes Floor Base 234. Fixed Barrier 10 extends vertically upward from Floor Base 234 and is joined to Rod 20 at the top end of Fixed Barrier 10. Rod 20 extends horizontally from Fixed Barrier 10, so that a tube or roll can be placed in the dispensing position between Fixed Barrier 10 and Retractable Barrier 50.

In some embodiments of the present invention, a pole 240 extends from Floor Base 234. The pole 240 is configured for traversing one or more Rolls 2 and holding the Roll(s) in a storage position.

Figure 18A:
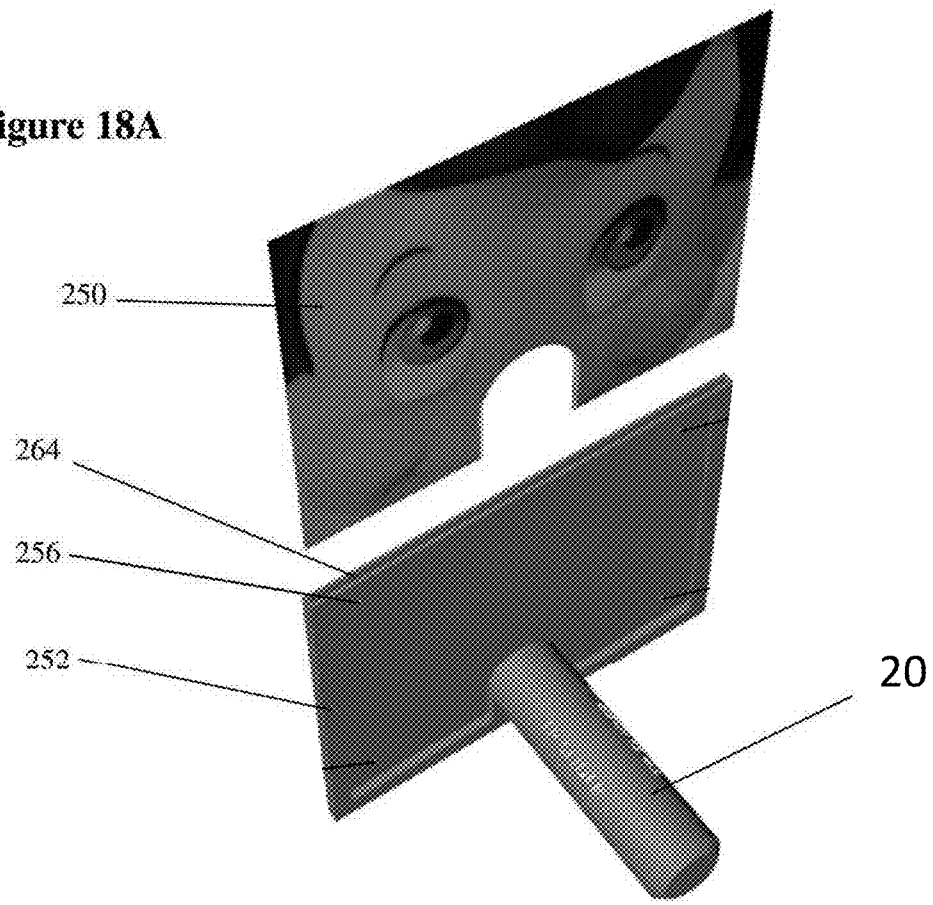
FIG. 18A is a perspective view of a "picture frame" version of the tube holder, with the picture shown before insertion into the frame, according to some embodiments of the present invention.
Figure 18B:
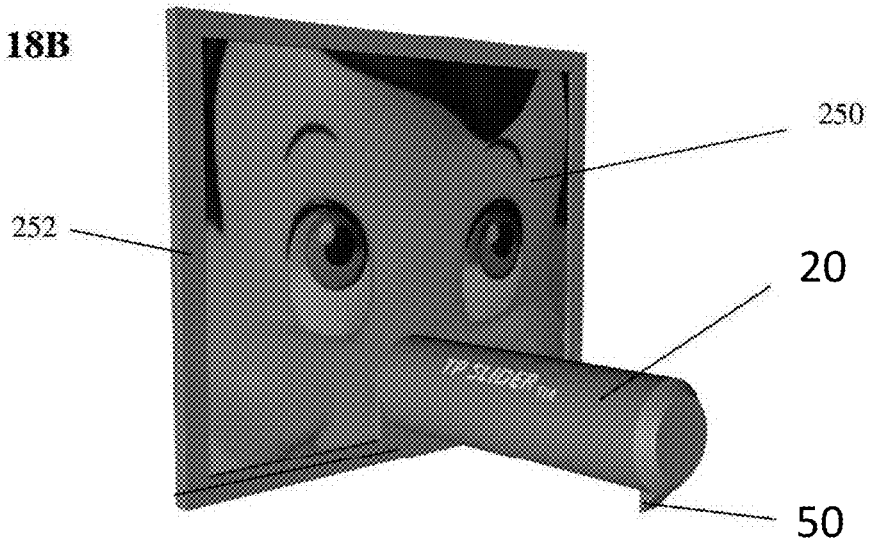
FIG. 18B is a perspective view of a "picture frame" version of the tube holder with the picture inserted into the frame, according to some embodiments of the present invention.

FIGS. 18A and 18B show some embodiments of the present invention, in which the tube holder includes Fixed Barrier 10 in the form of a frame into which a picture of Pinocchio can be placed, with the Rod 20 extending out where Pinocchio's nose would be. This is suitable for children to make the toilet a comfortable environment, especially when potty training. The picture could be an elephant, a unicorn, a rhinoceros, or any animal or character (like Cyrano DeBergerac) that has a projecting member that might be represented by the Rod or TP Roll. Alternatively, as a parody for use by older people, the picture could be of a politician or other person or character who lies, with the Rod representing the elongated "Pinocchio" nose. Or the picture could be any real or imagined person, place, scene or thing, or portion thereof, having a projecting portion that can be represented by the Rod and/or TP Roll.

In the tube holder of the examples of FIGS. 18A and 18B, the Fixed Barrier 10 includes a frame 252 having a slit 264 through which a picture 250 can be slid into the frame 252. The frame as a clear front surface 258, through which the picture 250 can be seen. The Rod 20 extends away from the frame 252.

FIGS. 19-21C relate to a second main embodiment of the present invention, in which the rod includes two retractable barriers.

In some embodiments of the present invention, shown in FIGS. 19-22*d*, the tube holder is configured for retaining multiple Rolls 2. The tube holder includes Fixed barrier 10 joined to the proximal end of Rod 20, Retractable Barrier 50 located at or near the distal end of Rod 20, and Intermediate Retractable Barrier 300 located between Fixed Barrier 10 and Retractable Barrier 50. The space on Rod 20 that lies between Fixed Barrier 10 and Intermediate Retractable Barrier 300 is a storage area/position in which one or more Rolls 2 are stored, while the space on Rod 20 that lies between Intermediate Retractable Barrier 300 and Retractable Barrier 50 is a dispensing area/position, where one Roll 2 is kept for dispensing the material wrapped around the inner tube of the roll (such as toilet paper, or paper towel, for example). Intermediate Retractable Barrier 300 may retract into and extend from Rod 20, as described above with respect to Retractable Barrier 50.

Figure 20A:
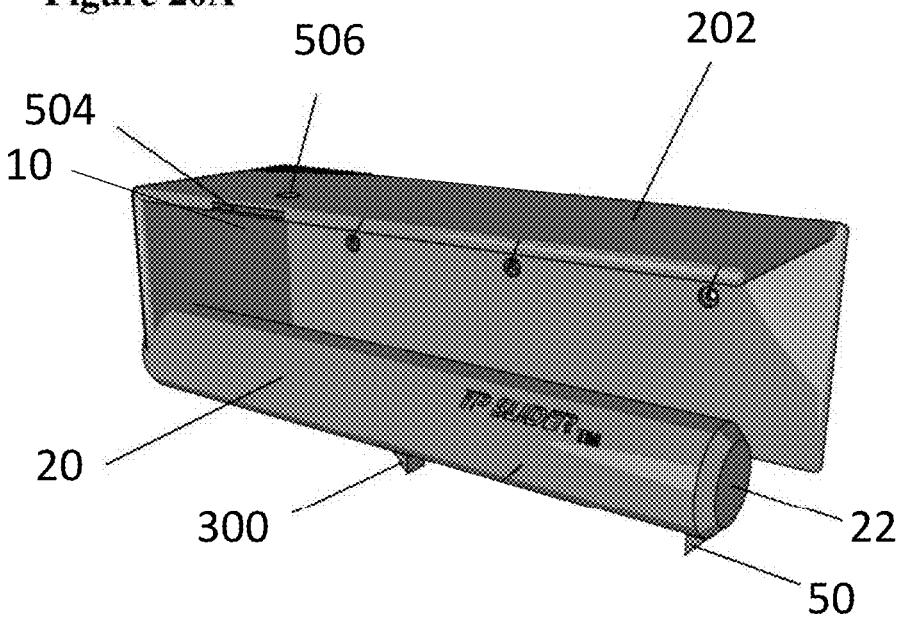
FIG. 20A is a perspective view of a "two-roll" tube holder adapted to hold two tubes, according to some embodiments of the present invention.
Figure 20B:
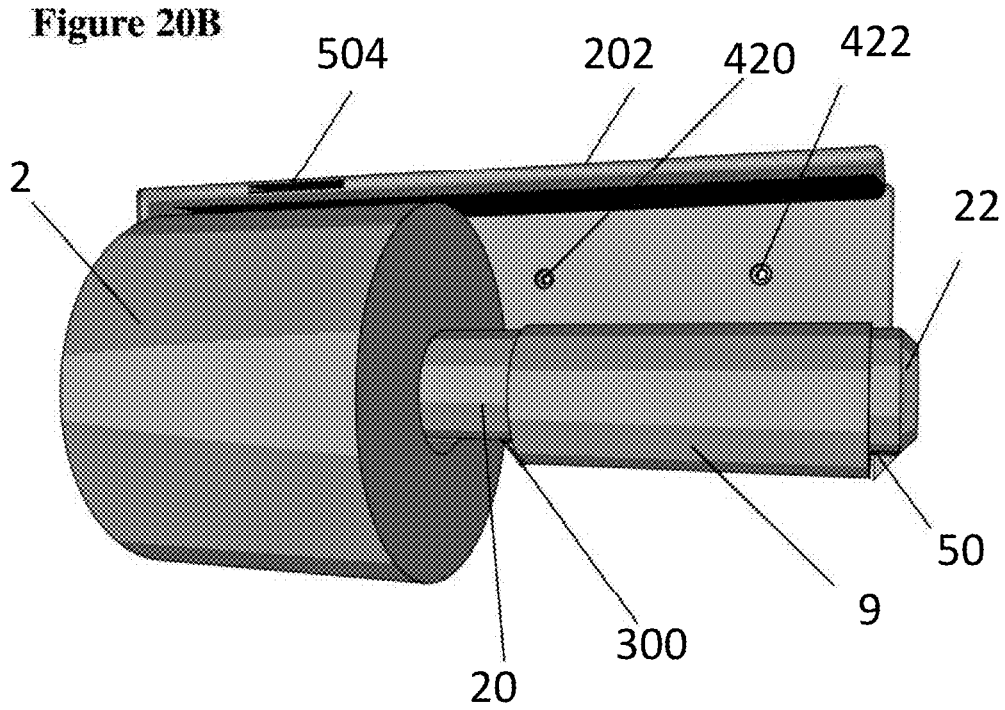
FIG. 20B is a front perspective view of the "two-roll" tube holder shown in FIG. 20A, showing an empty toilet paper roll in the dispensing position and a full toilet paper roll in a storage position, according to some embodiments of the present invention.

Rolls 2 are loaded from the distal end or Rod 20. The first Roll 2 is slid into the dispensing position between Retractable Barrier 50 and Intermediate Retractable Barrier 300. Then, the user moves the Intermediate Retractable Barrier 300 into its retracted position, by pushing the Intermediate Retractable Barrier 300 into Rod 20 with a finger, and slides the Roll 2 toward Fixed Barrier 10 over the retracted Intermediate Retractable Barrier 300, until Intermediate Retractable Barrier 300 is cleared and returns to its barrier position. Roll 2 is now in storage position between Fixed Barrier 10 and Intermediate Retractable Barrier 300, as shown in FIG. 20B. Once the storage area is full, or when the user no longer desires to add more rolls to the storage area, the user introduces a Roll 9 into the dispensing area between the Intermediate Retractable Barrier 300 and the Retractable Barrier 50.

Figure 20C:
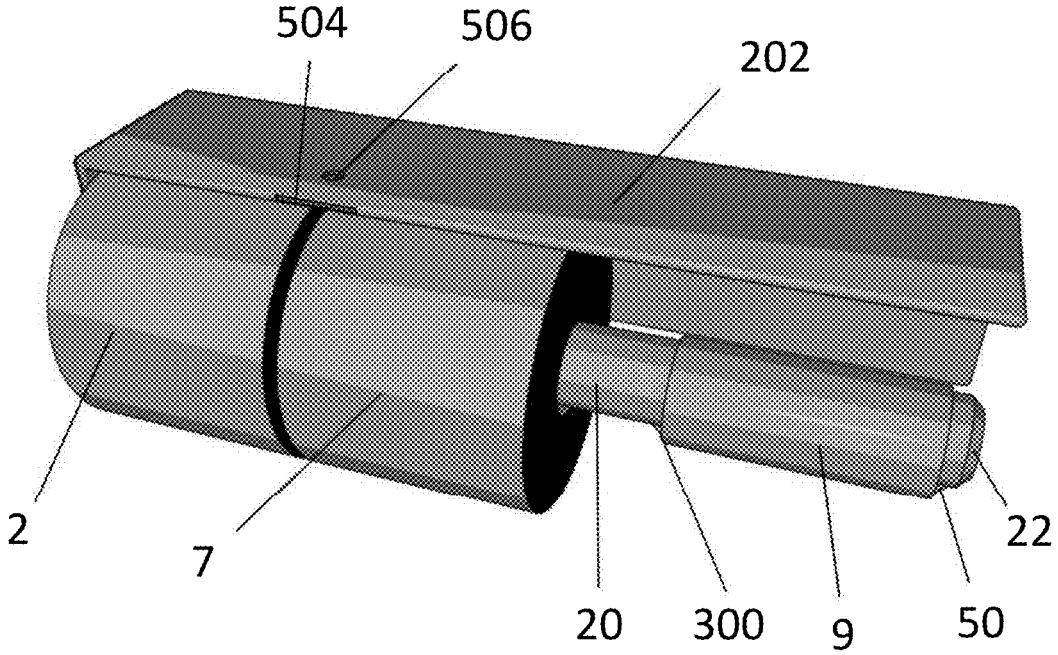
FIG. 20C is a perspective view of a "three-roll" tube holder, showing one empty toilet paper roll in a dispensing position and two full toilet paper rolls in a storage area of the rod, according to some embodiments of the present invention.
Figure 20D:
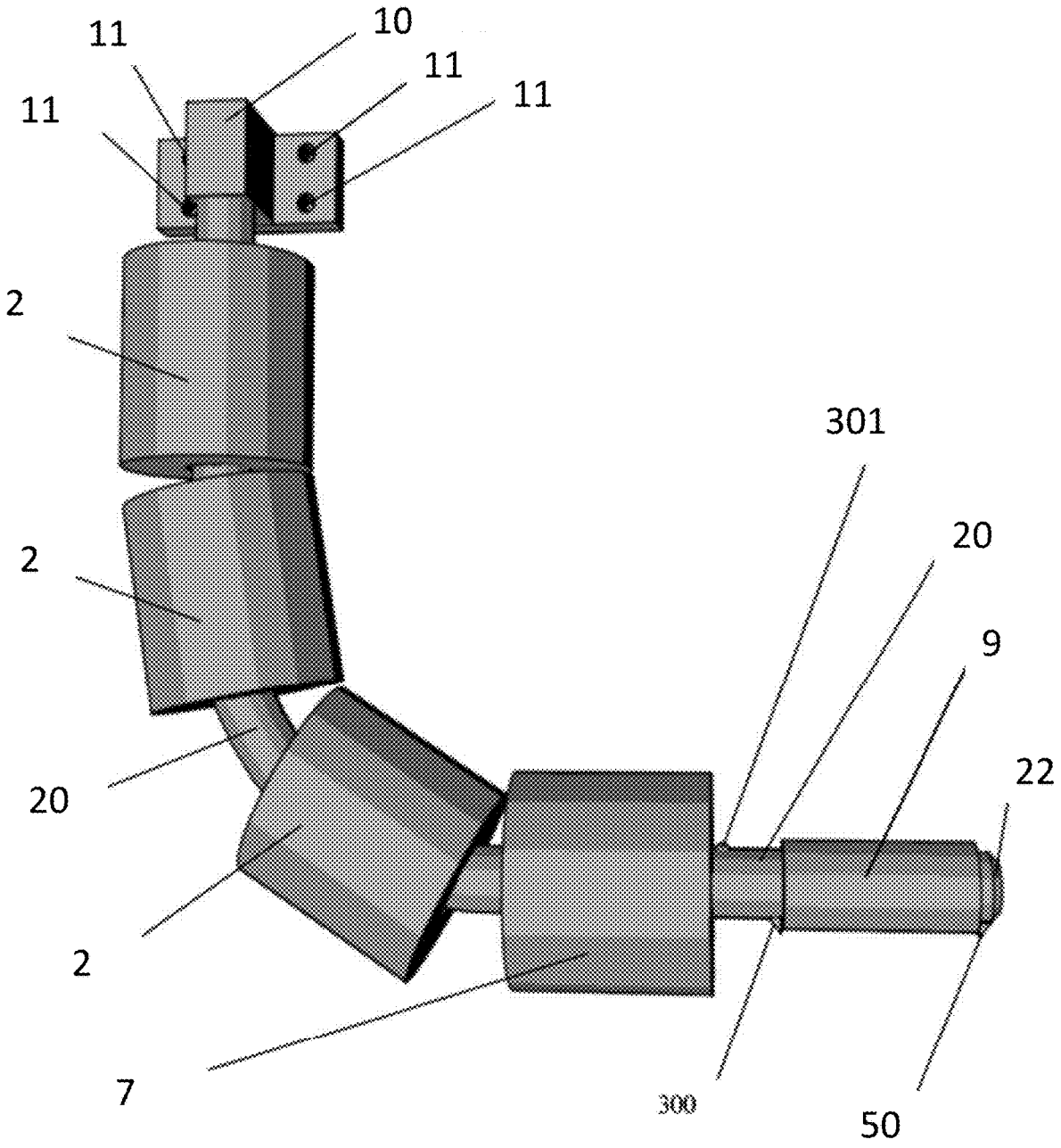
FIG. 20D is a perspective view of a "multi-roll" tube holder, showing one empty toilet paper roll in the dispensing position, and a plurality of full toilet paper rolls in a storage area of the rod.
Figure 20E:
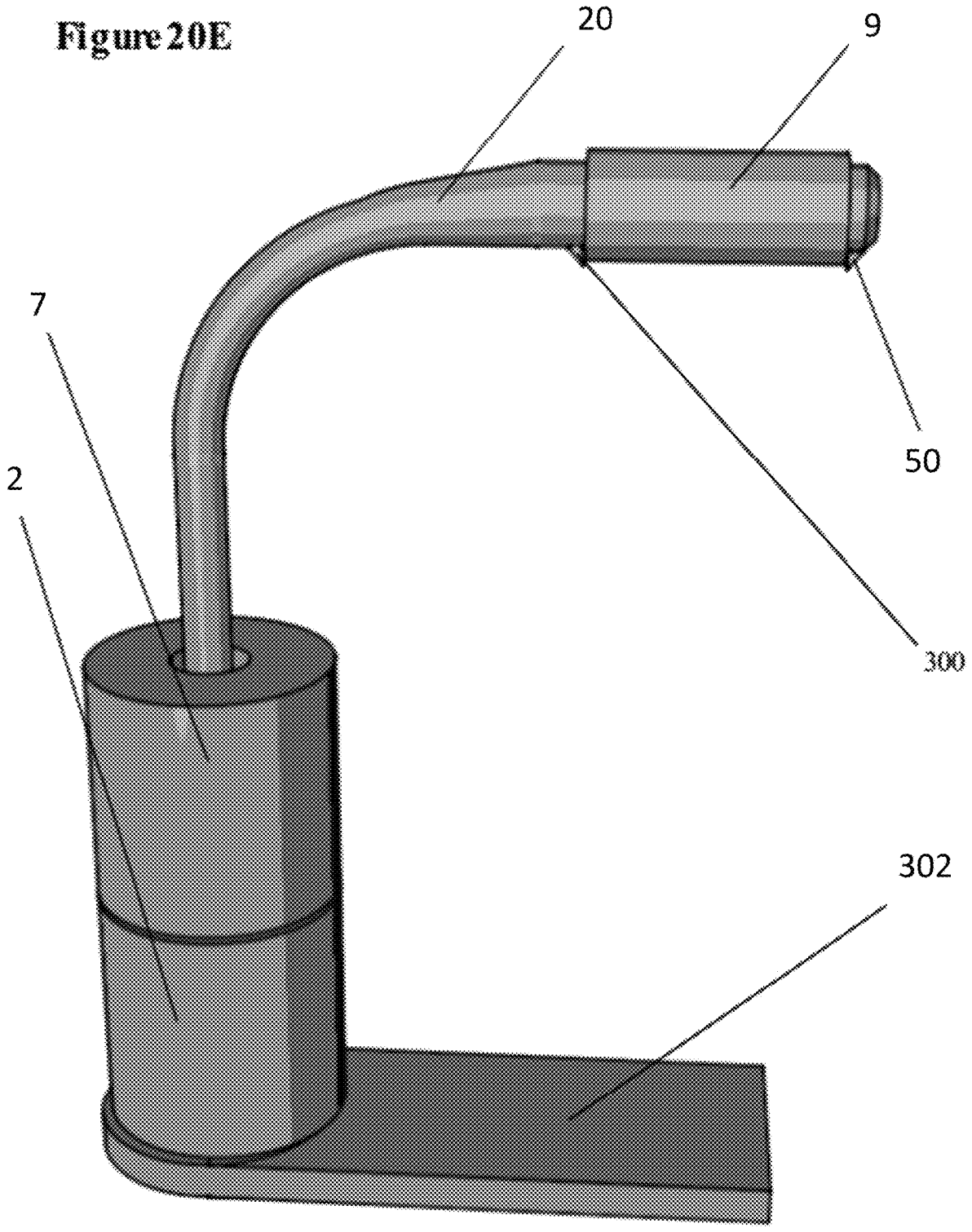
FIG. 20E is a perspective view of a "multi-roll floor model" tube holder showing one empty TP Roll in its Dispensing Position and two full TP Rolls in a storage area of the Rod.

If the storage area on the Rod 20 is large enough for more rolls, a second Roll 7 is also introduced in the storage area as shown in FIG. 20C. The storage area of Rod 20 may be curved, with Fixed Barrier 10 being higher than the distal end 22 of Rod 20, as shown in FIG. 20D. Fixed Barrier 10 has holes 11 to enable mounting Fixed Barrier 10 to the wall via screws. In some embodiments of the present invention, a Projection 301 is located in the storage area proximally of Intermediate Retractable Barrier 300, to prevent rolls in the storage area from advancing too close to Roll 9 in the dispensing area, as the rolls in the storage area are pulled downwards by gravity. The Roll 7 can be slid over the projection 301 by a user when the user wishes to move Roll 7 into the dispensing area. The storage area of Rod 20 may be curved and may extend from a floor base 302, as shown in FIG. 20E.

When Roll 9 is empty, the user pushes the Retractable Barrier 50 into its retracted position (with a finger) and pulls out the empty Roll 9, by sliding the empty Roll 9 over the retracted Retractable Barrier 50. The user then slides the Roll in the storage area that is closest to the dispensing area over Intermediate Retractable Barrier 300 to push the Intermediate Retractable Barrier 300 (which has an actuator surface 302 slanted toward Retractable Barrier 300) into its retracted position until the Roll that was formerly in the storage area clears the Intermediate Retractable Barrier 300 and is now in dispensing position between the Intermediate Retractable Barrier 300 and the Movable Barrier 50.

Figure 21A:
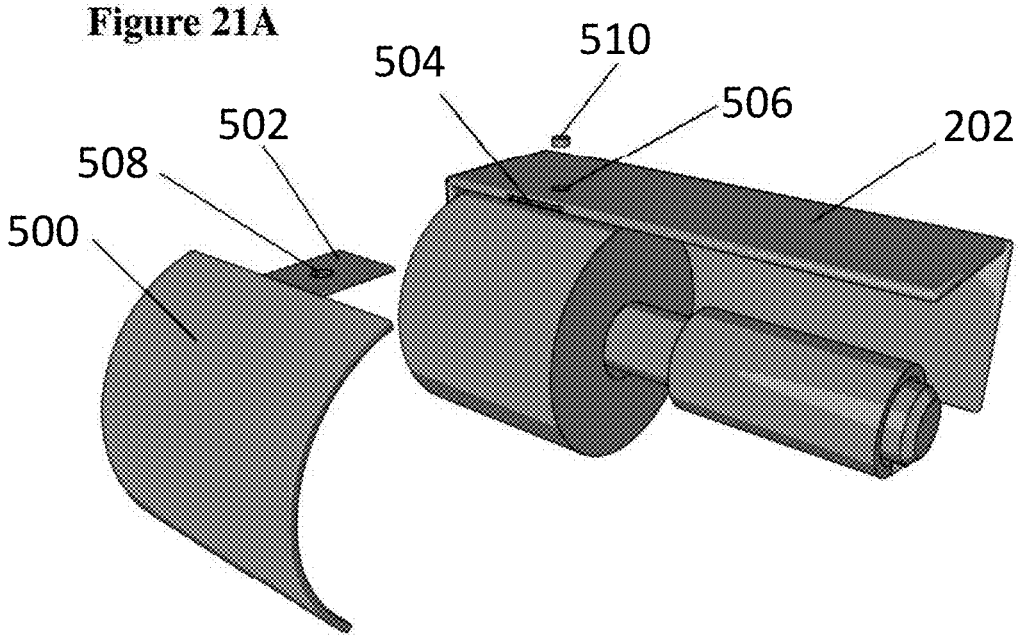
FIG. 21A is a perspective view of the "two-roll" tube holder of FIGS. 20A and 20B, with an uninstalled storage cover, according to some embodiments of the present invention.
Figure 21B:
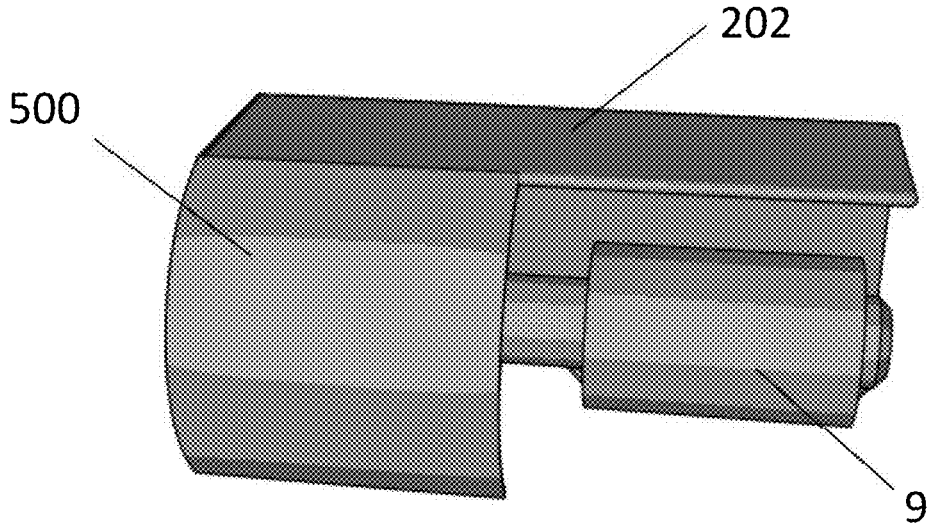
FIG. 21B is a perspective view of the "two-roll" tube holder shown in FIGS. 20A and 20B, with an installed storage cover, according to some embodiments of the present invention.
Figure 21C:
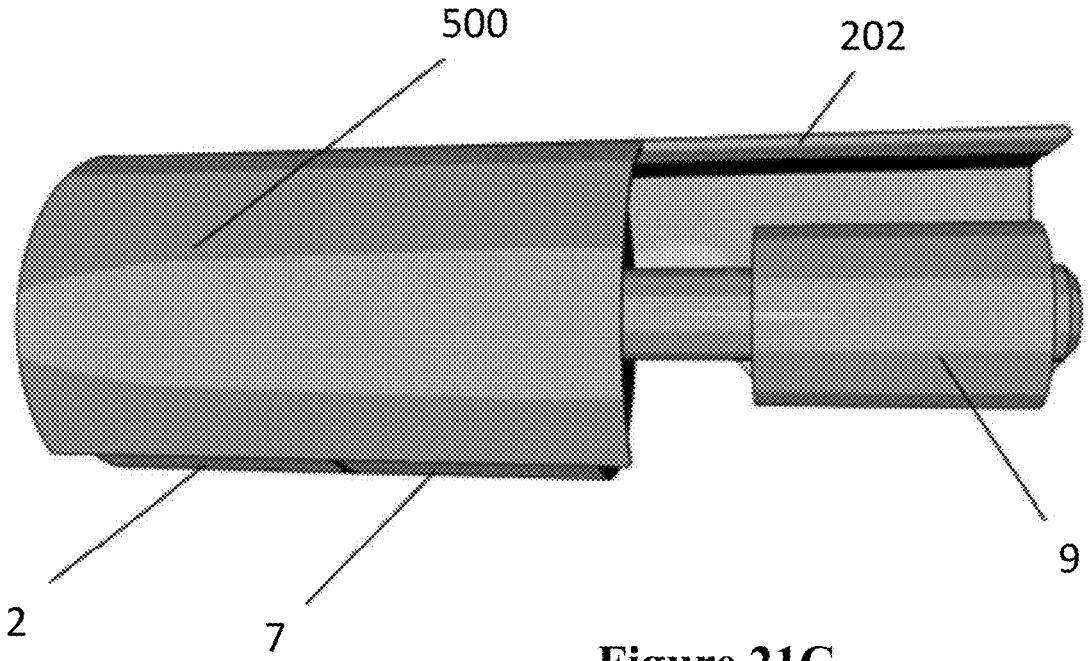
FIG. 21C is a perspective view of the "three-roll" tube holder shown in FIG. 20C, with an installed storage cover, according to some embodiments of the present invention.

As shown in FIGS. 21A-21C, a cover 500 may be present in order to cover the rolls in the storage area, in order to prevent a user from using said rolls and directing the use to use the roll in the dispensing area. The cover 500 may be removable, having a tongue 502 that can be inserted into a slit 504 on the shelf 202 shown in FIGS. 21A-21C. The shelf may include a hole 506 which can be aligned with the hole 508 of the tongue to secure the tongue 502 to the shelf 202 via a pin or a screw 510 traversing the holes 506 and 508.

Figure 19:
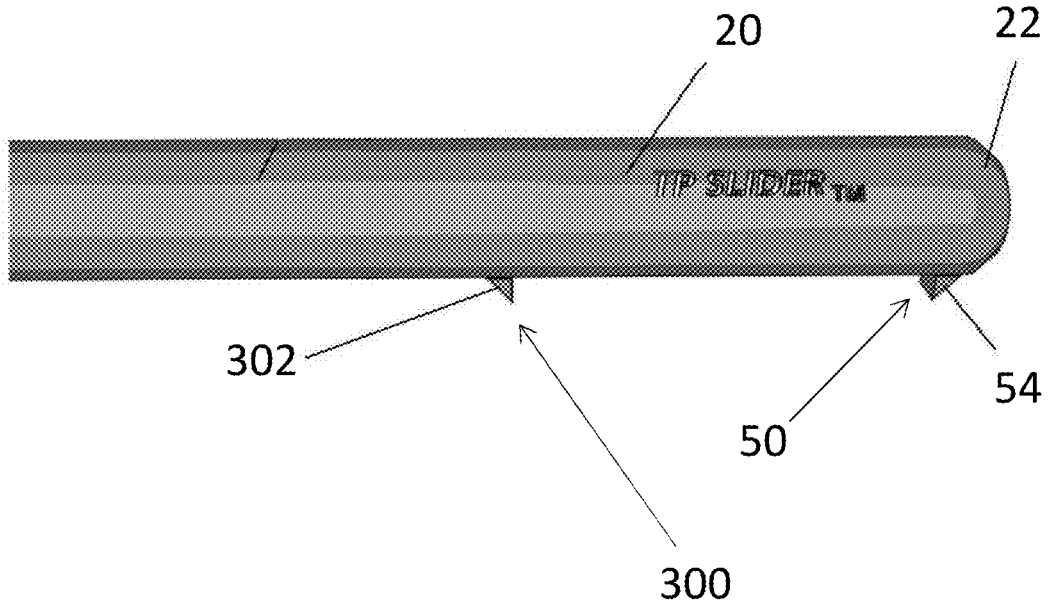
FIG. 19 is a front view of a second embodiment of the invention, adapted to hold more than one TP Roll, and containing two Retractable Barriers.

In the second main embodiment of the present invention, as shown clearly in the FIG. 19, Retractable Barrier 50 has a distal (actuator) surface 54 inclined radially outward and toward the proximal end of Rod 20, while Intermediate Retractable Barrier 300 has a proximal surface 302 inclined radially outward and toward the distal end of Rod 20. In some embodiments of the present invention, the distal surface of the retractable barrier 50 and the proximal surface of the intermediate retractable barrier 300 are oriented as mirror images of each other.

FIGS. 22A-23J illustrate a third main embodiment of the present invention in which the tube holder includes Movable Partial Barrier 550. Intermediate Retractable Barrier 300, and Fixed Barrier 10.

Figure 22A:
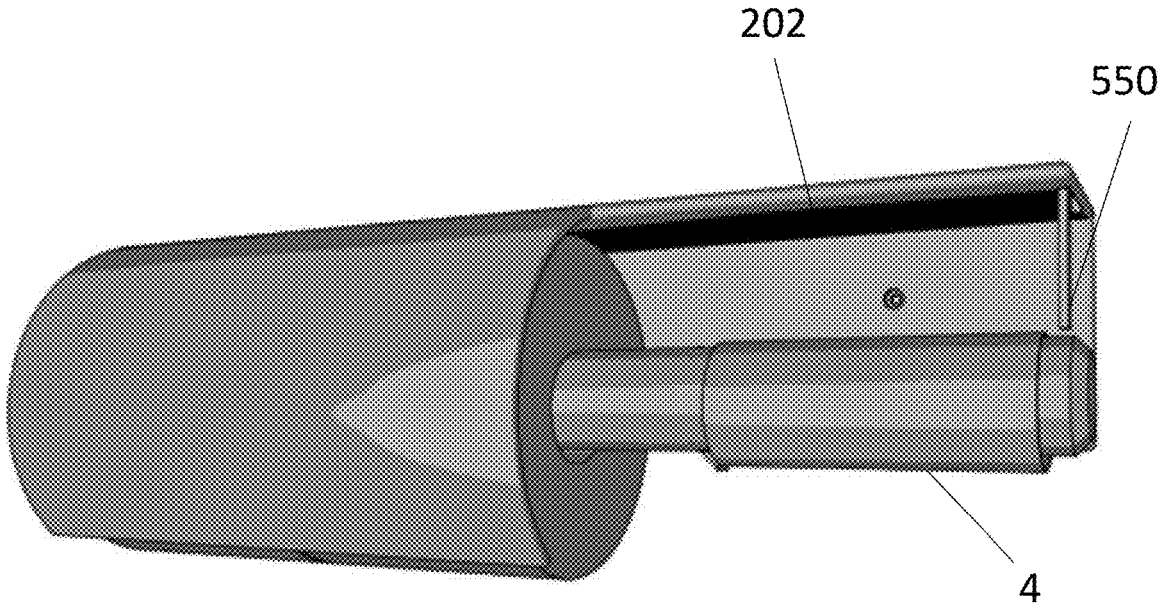
FIG. 22A is a front perspective view of the "swivel-arm" tube holder, wherein one of the retractable barriers in the form of a swivel-arm and is in its barrier position, according to some embodiments of the present invention.
Figure 22B:
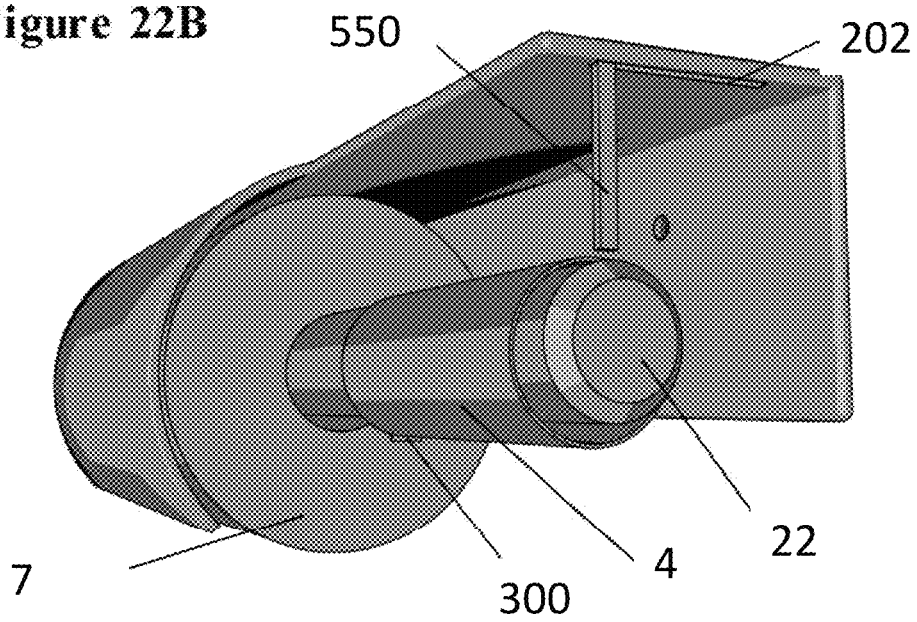
FIG. 22B is a side perspective view of the "swivel-arm" tube holder shown in FIG. 22A.
Figure 22C:
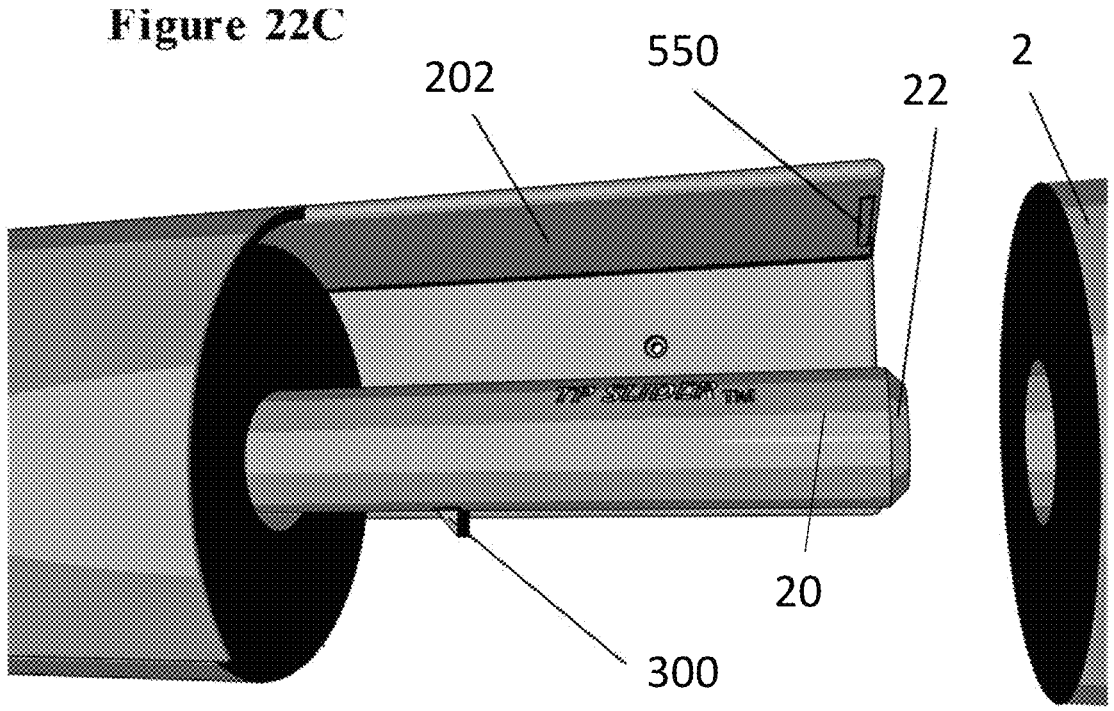
FIG. 22C is a front perspective view of the "swivel-arm" tube holder, showing the swivel-arm out of its barrier position, allowing a new toilet paper roll to be slid onto the rod, according to some embodiments of the present invention.

Referring now to the examples of FIGS. 22A-22D, Movable Partial Barrier 550 is in the form of a tab configured to swivel from a panel or shelf 202 above Rod 20 near the distal end 22 of Rod 20. The tab can be rotated between a dispensing (or operative) position (FIGS. 22A, 22B, 22D) and a retracted (or inoperative) position (FIG. 22C). In the dispensing (or operative) position, the tab is positioned to allow the inner tube 4 of a roll to slide past the tab between the tab and the Rod 20, but not allow the material (toilet paper, for example) joined to the inner tube 4 to slide past it. In the retracted (or inoperative) position, the tab is retracted toward the panel/shelf 202 to allow passage of a full roll from outside into the dispensing position. In some embodiment of the present invention, the tube holder includes locking means to lock the swivel arm in its operative position.

The tube holder of the examples of FIGS. 22A-22D may include a storage area and a dispensing area with an intermediate movable barrier therebetween, as described above. The dispensing area may be configured for storing one or more rolls and may be covered by a cover 500, as explained above.

In the examples of FIGS. 22A-22D, in order to load the tube holder, Tab (Movable Partial Barrier) 550 is moved by the user into the retracted position to insert a Roll into the dispensing area between Tab 550 and Intermediate Retractable Barrier 300 (FIG. 22C). The user the pushed the Intermediate Retractable Barrier 300 into its retracted position within Rod 20 (as described above), and the Rolls are slid by the user on Rod 20 over the retracted Intermediate Retractable Barrier 300.

Figure 22D:
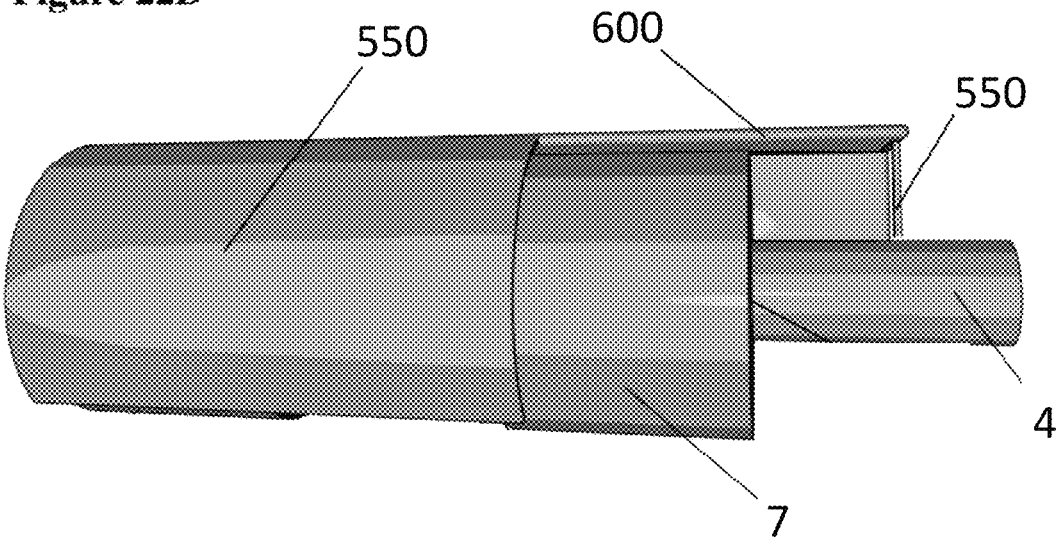
FIG. 22D is a front perspective view of the "swivel-arm" tube holder shown in FIGS. 22A through 22C, showing the swivel-arm in its barrier position and one finger sliding a new toilet paper roll into its dispensing position while simultaneously removing an empty toilet paper roll off of the rod.

As seen in FIG. 22D, once the Roll in the dispensing position is fully used and only the Inner Tube 4 is left, the user can slide the Roll 7 from the storage area to the dispensing area by touching Roll 7 alone. While sliding along Rod 20, Roll 7 pushes against the actuation surface of Intermediate Retractable Barrier 300 to retract Intermediate Retractable Barrier 300 into Rod 20 and move to the dispensing area. While sliding, the Roll 7 contacts Inner Tube 4 and pushes Inner Tube 4 out of Rod 20 through the gap between Rod 20 and Tab 550. while Tab 550 is still in its dispending position. Therefore, the user's required contact with the tube holder is minimized, as the user simply needed to push Roll 7 to both move Roll 7 to the dispensing area of Rod 20 and to push Inner Tube 4 out of Rod 20. This minimizes user contact with the tube holder, and provides for a more sanitary environment.

Referring now to FIGS. 23A-23J, Movable Partial Barrier 550 is in the form of a drawer or box.

The tube holder includes an upper panel/shelf 202 located above Rod 20. A side panel 600 extends downward from the upper panel distally from the distal end 22 of Rod 20. A base panel 602 extends from a bottom end of the side panel 600 toward Rod 20.

Movable Partial Barrier 550 in a form of a drawer having a proximal sidewall 604, a distal sidewall 606, and a base 608. The drawer is configured to be supported by the base panel 602 and to fit between the side panel 600 and the distal end 22 of Rod 20.

In the barrier position, the drawer is positioned such that the proximal sidewall 604 is a vicinity of the distal end 22 of Rod 20, to block the axial movement of the tube/roll out of Rod 20 from the distal end of Rod 20. In the retracted position, the drawer is removed from the base panel.

Figure 23A:
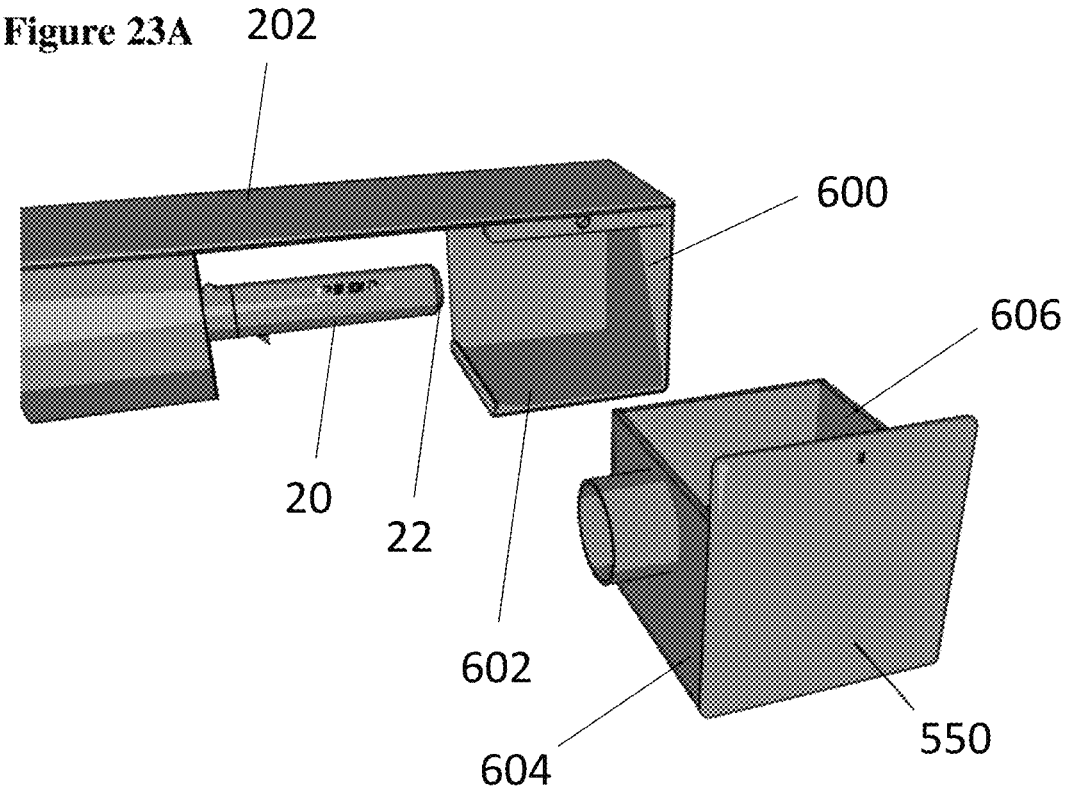
FIG. 23A is a perspective view of the "box version" tube holder, wherein one of the retractable barrier is in the form of a removable box, that is shown removed from its shelf, according to some embodiments of the present invention.
Figure 23B:
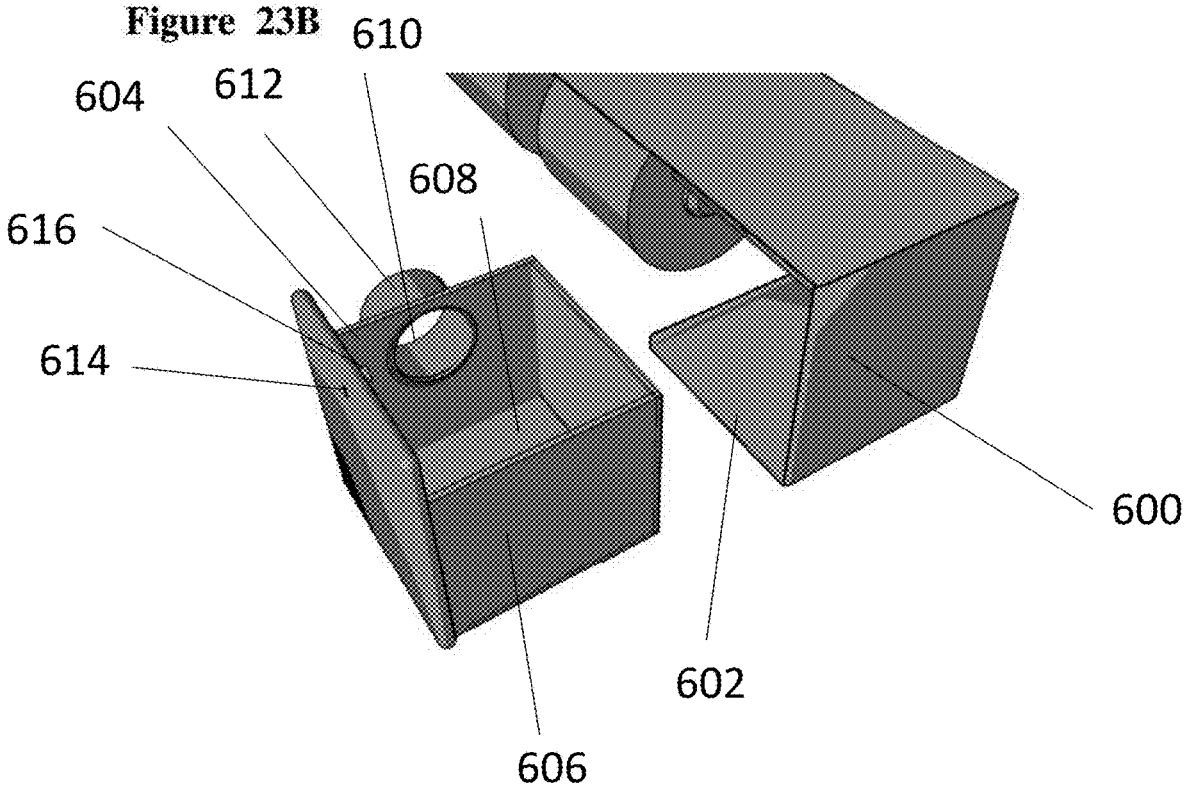
FIG. 23B is a top perspective view of the "box version" tube holder of FIG. 23A, showing the inside of the empty box and a new toilet paper roll in its dispensing position.
Figure 23C:
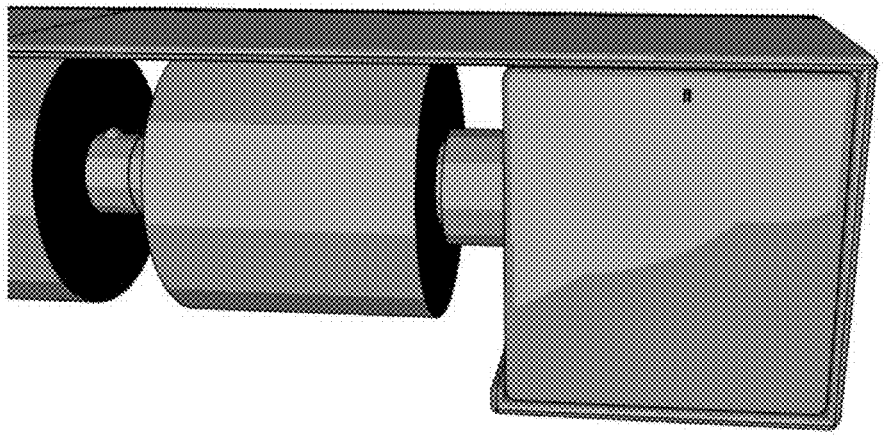
FIG. 23C is a front perspective view of the "box version" tube holder of FIG. 23B, with the removable box shown in its Barrier Position on its shelf.
Figure 23D:
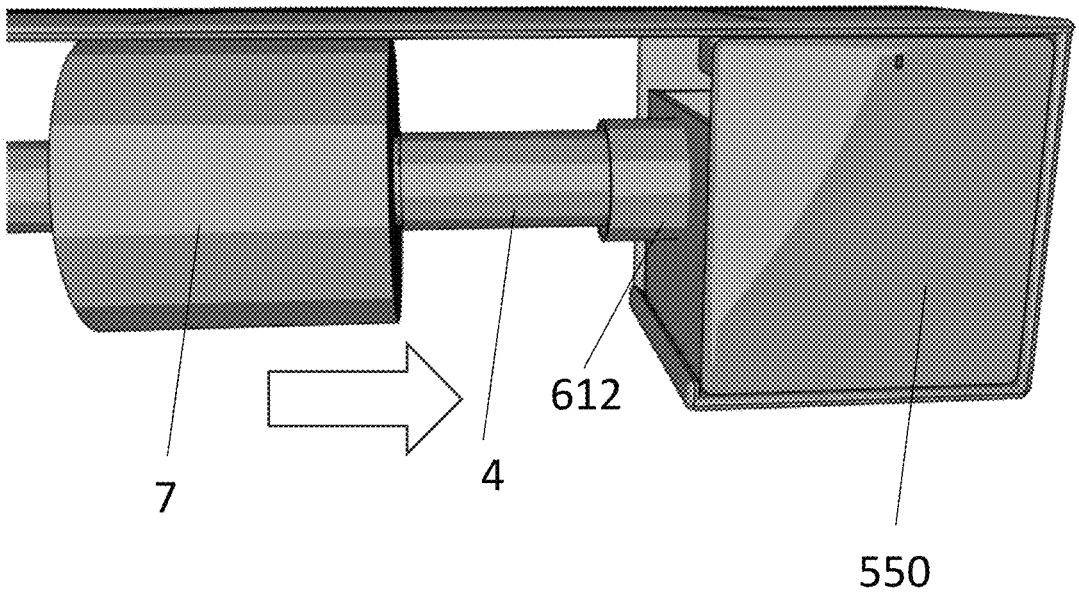
FIG. 23D is a front perspective view of the "box version" tube holder of FIG. 23C, showing a new toilet paper roll being slid from the storage area of the rod into its dispensing position while an empty toilet paper roll is being removed from the rod and slid into the box.
Figure 23E:
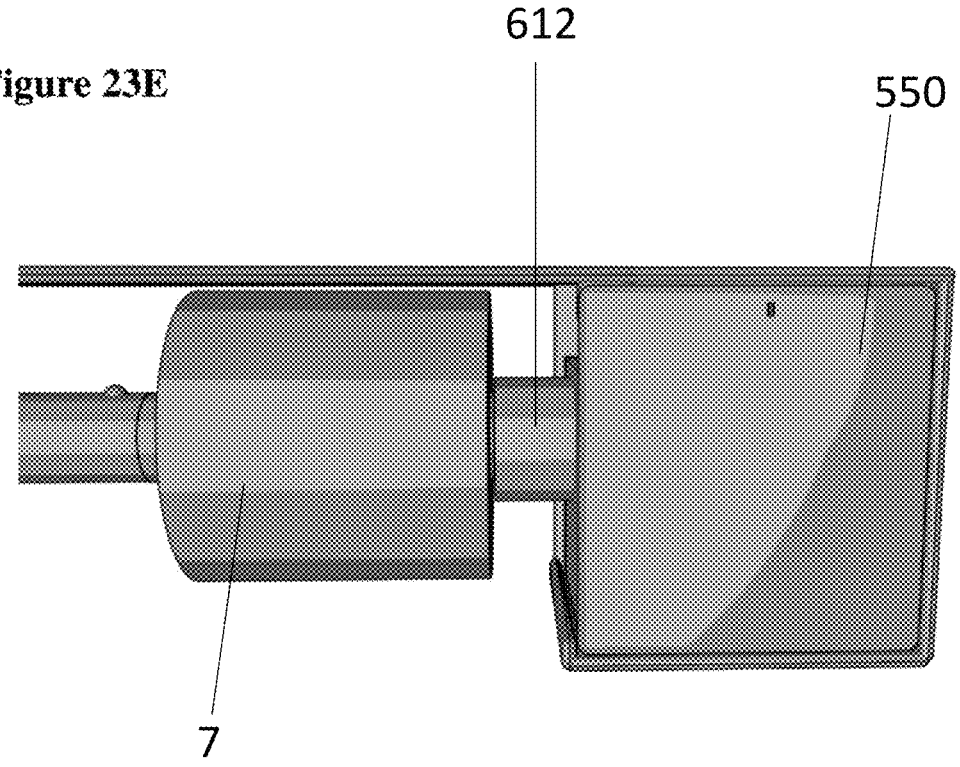
FIG. 23E is a front perspective view of the "box version" tube holder of FIG. 23D, showing the new toilet paper roll after it has been loaded into it Dispensing Position.

In some embodiments of the present invention, the proximal sidewall 604 of the drawer has an aperture 610 having a radius that is larger than an outer radius of an empty tube (inner tube of a roll) 4 and smaller than a radius of a tube with a roll of material joined to the tube. A hollow cylindrical shaft 612 surrounds the aperture 610 and extends from the proximal wall 604 toward Rod 20. In this manner, an empty inner tube 4 is configured to be movable from the rod into the drawer 50 via the shaft 612 and aperture 610 as seen in FIGS. 23D and 23E, in which a Roll 7 is pushed from the storage area to the dispensing area, to move the empty inner tube 4 from the dispensing area into the drawer (Movable Barrier) 550. Roll 7 with material is too large to enter the shaft 512, as seen in FIGS. 23E and 23G.

Figure 23F:
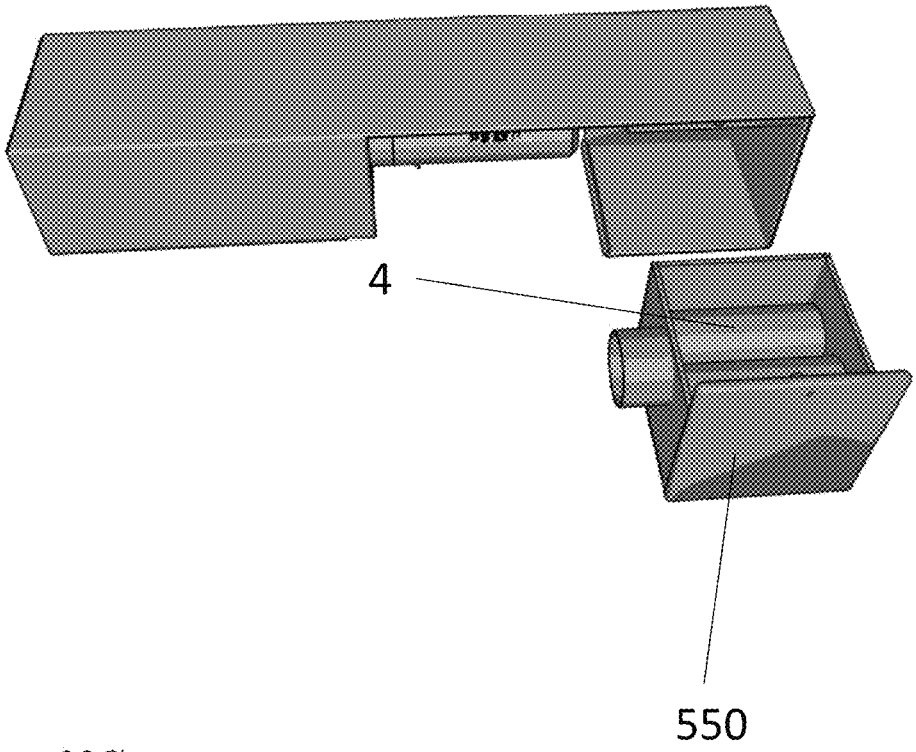
FIG. 23F is a top perspective view of the "box version" tube holder of FIG. 23E, showing the removed box containing empty toilet paper rolls to be thrown away.
Figure 23G:
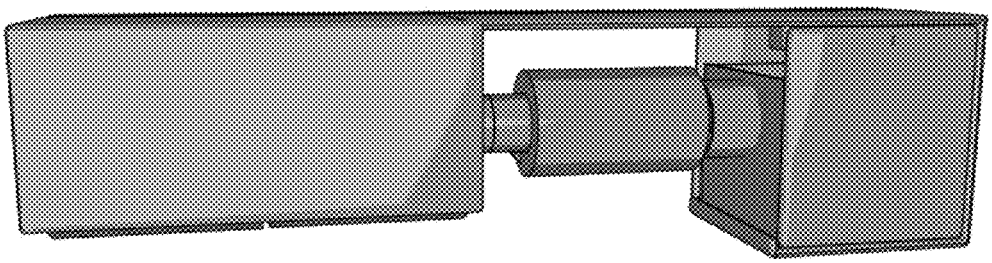
FIG. 23G is a front perspective view of a "Triple Roll—box version" tube holder showing one partially used toilet paper roll in its dispensing position and two full toilet paper rolls in storage position.

In FIG. 23F, the drawer 50 is removed when full of empty inner tubes, in order to be emptied.

Figure 23H:
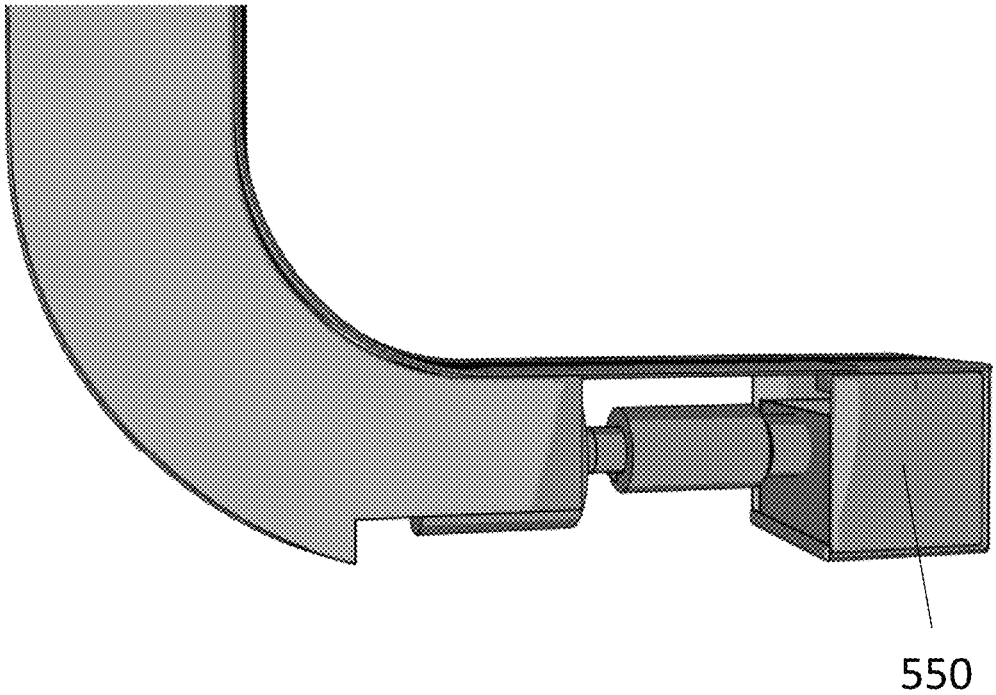
FIG. 23H is a front perspective view of a "Multi Roll—box version" tube holder, according to some embodiments of the present invention.
Figure 23J:
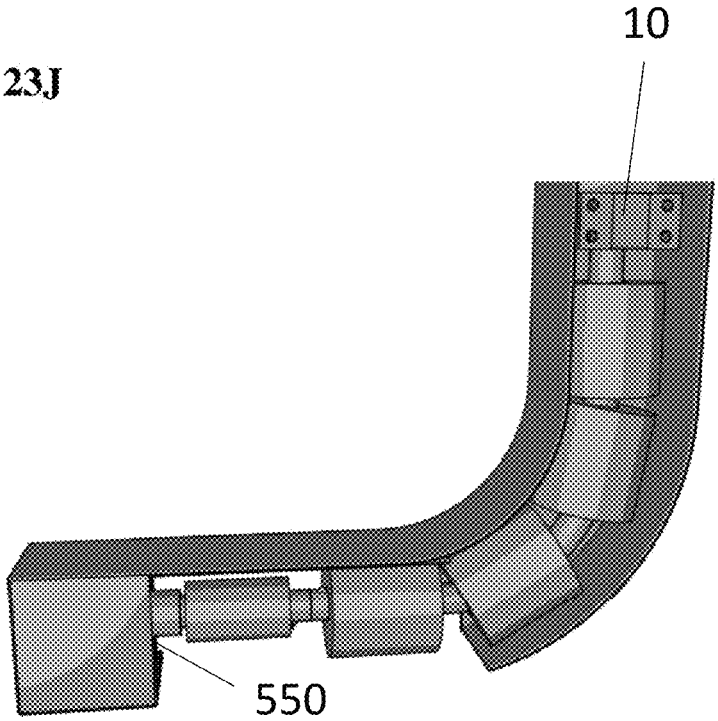
FIG. 23J is a rear perspective view of the "Multi Roll—box version" tube holder of FIG. 23H.

FIGS. 23H and 23J are analogous to FIG. 20D, in which the storage area of the tube is curved and Fixed Wall 10 is higher than the drawer/movable barrier 50.

In some embodiments the drawer includes a locking mechanism for locking the drawer unto the shelf 202 to prevent stealing of toilet paper rolls in a retail establishment. Personnel working in the retail establishment may have a key to unlock the drawer in order to remove the drawer to dispose of empty tubes in the drawer and to load the tube holder. The locking mechanism 616 may be accessible through a keyhole 614.

As explained above, regarding the example of FIGS. 22A-22D, the tube holder of FIGS. 23A-23J requires the user to simply slide a roll from the storage area to the dispensing area in order to simultaneously move a roll from the storage area to the dispensing area and to push an empty roll out of Rod 20 and into the drawer. This minimizes user contact with the tube holder and provides for a more sanitary environment.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A tube holder comprising:

a rod having an outer diameter that is smaller than an inner diameter of a tube, wherein said rod is adapted to receive said tube thereon;

two barriers adapted to keep said tube in a dispensing position on said rod between said barriers; and at least one of said barriers being a retractable barrier adapted to move between an extended position and a retracted position within said rod, said extended position preventing axial movement of said tube past said retractable barrier and said retracted position allowing axial movement of said tube past said retractable barrier, whereby said tube holder is configured for loading said tube into said dispensing position when said retractable barrier is in said retracted position and for locking said tube into said dispensing position when said retractable barrier is in its extended position, requiring manual contact between said retractable barrier and an object other than said tube, to push said retractable barrier into said rod in order to remove said tube from said dispensing position;

wherein said retractable barrier faces downward and is biased to remain in said extended position by gravity;

wherein said rod has a shaft with an aperture facing downward and opening on a radial surface of said rod, said shaft having a narrow section near said aperture and an expanded section extending from an end of said narrow section opposite said aperture, such that ledges form where the expanded section meets the narrow section;

wherein said retractable barrier is slidable in an out of the shaft and comprises overhangs extending from sides of said retractable barrier;

wherein when said retractable barrier is extended, a portion of said retractable barrier extends out of the said shaft and said overhangs contact said ledges, to prevent said retractable barrier from falling from said shaft.

2. The tube holder of claim 1, wherein said retractable barrier includes an actuator surface configured to move said retractable barrier into said retracted position upon contact by the tube sliding into said dispensing position from a first axial direction.

3. The tube holder of claim 1, further comprising means for attaching the tube holder to a wall.

4. The tube holder of claim 1, wherein the tube holder is fixed to a floor stand.

5. The tube holder of claim 1, wherein the tube holder is integrally formed with a floor stand.

6. A tube holder comprising:

a rod having an outer diameter that is smaller than an inner diameter of a tube, wherein said rod is adapted to receive said tube thereon;

mounting means for mounting said rod to a wall;

a retractable barrier at a distal end of said rod adapted to move between an extended position and a retracted position within said rod, said extended position preventing axial movement of said tube past said retractable barrier and said retracted position allowing axial movement of said tube past said retractable barrier;

said retractable barrier being adapted to keep said tube in a dispensing position on said rod between said retractable barrier and said wall; and whereby said tube holder is configured for loading said tube from the distal end of said rod toward said wall into said dispensing position when said retractable barrier is in said retracted position and for locking said tube into said dispensing position when said retractable barrier is in its extended position, requiring manual contact between said retractable barrier and an object other than said tube, to push said retractable barrier into said rod in order to remove said tube from said dispensing position;

wherein said retractable barrier faces downward and is biased to remain in said extended position by gravity, wherein said rod has a shaft with an aperture facing downward and opening on a radial surface of said rod, said shaft having a narrow section near said aperture and an expanded section extending from an end of said narrow section opposite said aperture, such that ledges form where the expanded section meets the narrow section;

wherein said retractable barrier is slidable in an out of the shaft and comprises overhangs extending from sides of said retractable barrier;

wherein when said retractable barrier is extended, a portion of said retractable barrier extends out of the said shaft and said overhangs contact said ledges, to prevent said retractable barrier from falling from said shaft.

7. A tube holder comprising:

a rod having an outer diameter that is smaller than an inner diameter of a tube, wherein said rod is adapted to receive said tube thereon;

a stationary barrier at a proximal end of said rod, for preventing axial movement of said tube past said stationary barrier;

a retractable barrier at a distal end of said rod adapted to move between an extended position and a retracted position within said rod, said extended position preventing axial movement of said tube past said retractable barrier and said retracted position allowing axial movement of said tube past said retractable barrier;

said barriers adapted to keep said tube in a dispensing position on said rod between said barriers; and whereby said tube holder is configured for loading said tube from the distal end of said rod and into said dispensing position when said retractable barrier is in said retracted position and for locking said tube into said dispensing position when said retractable barrier is in its extended position, requiring manual contact between said retractable barrier and an object other than said tube, to push said retractable barrier into said rod in order to remove said tube from said dispensing position;

wherein said retractable barrier faces downward and is biased to remain in said extended position by gravity;

wherein said rod has a shaft with an aperture facing downward and opening on a radial surface of said rod, said shaft having a narrow section near said aperture and an expanded section extending from an end of said narrow section opposite said aperture, such that ledges form where the expanded section meets the narrow section;

wherein said retractable barrier is slidable in an out of the shaft and comprises overhangs extending from sides of said retractable barrier;

wherein when said retractable barrier is extended, a portion of said retractable barrier extends out of the said shaft and said overhangs contact said ledges, to prevent said retractable barrier from falling from said shaft.

8. The tube holder of claim 7, wherein said retractable barrier includes an actuator surface configured to automatically move said retractable barrier into said retracted position upon contact by the tube sliding into said dispensing position.

9. The tube holder of claim 7, wherein the outer diameter at the distal end of the rod is smaller than the outer diameter of the rest of the rod, to ease a loading of a tube onto the rod from the distal end of the rod.

10. The tube holder of claim 7, further comprising means for attaching the tube holder to a wall.

11. The tube holder of claim 7, wherein the tube holder is fixed to a floor stand.

12. The tube holder of claim 7, wherein the tube holder is integrally formed with a floor stand.

13. The tube holder of claim 7, further comprising a button surface on said retractable barrier to manually move said retractable barrier into said retracted position, whereby said tube can be easily moved out of said dispensing position and unloaded from said rod.

* * * * *